US012121106B2

(12) United States Patent
Blanche et al.

(10) Patent No.: US 12,121,106 B2
(45) Date of Patent: Oct. 22, 2024

(54) SOLE STRUCTURE FOR ARTICLE OF FOOTWEAR

(71) Applicant: NIKE, Inc., Beaverton, OR (US)

(72) Inventors: Rory S. Blanche, Portland, OR (US); Kaigin Olafson, Beaverton, OR (US); James Zormeir, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 107 days.

(21) Appl. No.: 17/841,617

(22) Filed: Jun. 15, 2022

(65) Prior Publication Data

US 2022/0304420 A1 Sep. 29, 2022

Related U.S. Application Data

(63) Continuation of application No. 16/796,061, filed on Feb. 20, 2020, now Pat. No. 11,382,389.

(60) Provisional application No. 62/809,309, filed on Feb. 22, 2019.

(51) Int. Cl.

| | |
|---|---|
| ***A43B 7/14*** | (2022.01) |
| ***A43B 3/26*** | (2006.01) |
| ***A43B 7/142*** | (2022.01) |
| ***A43B 7/24*** | (2006.01) |
| ***A43B 23/02*** | (2006.01) |
| ***A43C 11/00*** | (2006.01) |

(52) U.S. Cl.

CPC ..... *A43B 23/027* (2013.01); *A43B 3/26* (2013.01); *A43B 7/142* (2013.01); *A43B 7/1495* (2013.01); *A43B 7/24* (2013.01); *A43B 23/0275* (2013.01); *A43C 11/00* (2013.01)

(58) Field of Classification Search

CPC ... A43B 7/142; A43B 7/1495; A43B 23/0275; A43B 7/24

USPC ..... 36/91, 142, 143, 144

See application file for complete search history.

(56) References Cited

U.S. PATENT DOCUMENTS

| | | | |
|---|---|---|---|
| 3,768,182 | A | 10/1973 | Powers |
| 4,550,511 | A | 11/1985 | Gamm |
| 4,670,998 | A | 6/1987 | Pasternak |

(Continued)

FOREIGN PATENT DOCUMENTS

JP 2017510381 A 4/2017

OTHER PUBLICATIONS

Office Action in Korean Patent Application No. 10-2021-7029819, dated Jun. 22, 2023 (9 pages).

(Continued)

*Primary Examiner* — Marie D Bays

(74) *Attorney, Agent, or Firm* — BOOKOFF MCANDREWS, PLLC

(57) ABSTRACT

An article of footwear includes an upper and a sole structure attached to the upper. The article of footwear also includes a cradle having a base extending between the upper and the sole structure, a first sidewall extending from the base and along a first side of the upper, and a second sidewall extending from the base along a second side of the upper, each of the first sidewall and the second sidewall including a plurality of eyelets. The article of footwear further includes a cable operable to move the upper between a relaxed state and a tightened state. The cable including a first strand extending through at least one of the eyelets of the first sidewall and a second strand extending through at least one of the eyelets of the second sidewall.

18 Claims, 12 Drawing Sheets

(56) References Cited

U.S. PATENT DOCUMENTS

| | | | | |
|---|---|---|---|---|
| 4,811,500 | A | 3/1989 | Maccano | |
| 4,823,485 | A | 4/1989 | Kemmer | |
| 5,291,671 | A | 3/1994 | Caberlotto et al. | |
| 5,416,987 | A | 5/1995 | Bemis et al. | |
| 5,566,475 | A | 10/1996 | Donnadieu | |
| 5,692,319 | A * | 12/1997 | Parker | A43C 1/00 36/114 |
| 5,704,138 | A | 1/1998 | Donnadieu | |
| 5,950,335 | A | 9/1999 | Okajima | |
| 5,966,841 | A | 10/1999 | Barret | |
| 6,073,370 | A | 6/2000 | Okajima | |
| 6,401,366 | B2 * | 6/2002 | Foxen | A43B 7/1495 36/102 |
| 7,347,012 | B2 | 3/2008 | Clark et al. | |
| 8,875,418 | B2 | 11/2014 | Long | |
| 8,973,288 | B2 | 3/2015 | Dojan et al. | |
| 10,856,619 | B2 | 12/2020 | Fuerst et al. | |
| 2007/0011912 | A1 | 1/2007 | Clark et al. | |
| 2009/0090027 | A1 | 4/2009 | Baudouin | |
| 2010/0037483 | A1 | 2/2010 | Meschter et al. | |
| 2011/0185597 | A1 * | 8/2011 | Guest | A43B 5/001 36/127 |
| 2011/0239486 | A1 * | 10/2011 | Berger | A43B 7/1495 36/25 R |
| 2014/0223779 | A1 | 8/2014 | Elder et al. | |
| 2017/0079372 | A1 * | 3/2017 | Duarte | A43B 7/226 |
| 2017/0181501 | A1 | 6/2017 | Gautier et al. | |
| 2017/0231319 | A1 * | 8/2017 | Bohnsack | A43B 13/04 36/92 |
| 2017/0251750 | A1 * | 9/2017 | Devoe | A43B 7/1495 |
| 2017/0280826 | A1 | 10/2017 | Farris et al. | |
| 2018/0220734 | A1 | 8/2018 | Dyer et al. | |
| 2018/0228244 | A1 | 8/2018 | Dyer et al. | |
| 2020/0080242 | A1 * | 3/2020 | Dardinski | D04B 1/108 |
| 2020/0268106 | A1 * | 8/2020 | Blanche | A43B 11/00 |

OTHER PUBLICATIONS

European Patent Office as ISA, International Search Report and Written Opinion for PCT Application No. PCT/US2020/019015, mailed Jun. 18, 2020.

The International Bureau of WIPO, PCT International Preliminary Report on Patentability and Written Opinion for application No. PCT/US2020/019015 dated Sep. 2, 2021.

The State Intellectual Property Office (P.R.C.), First Office Action for CN App. 202080029483.1, mailed Aug. 17, 2022.

* cited by examiner

SOLE STRUCTURE FOR ARTICLE OF FOOTWEAR

CROSS REFERENCE TO RELATED APPLICATIONS

This application is a continuation of U.S. patent application Ser. No. 16/796,061, filed Feb. 20, 2020, which claims priority under 35 U.S.C. § 119(e) to U.S. Provisional Application No. 62/809,309, filed on Feb. 22, 2019. The disclosures of these prior applications are considered part of the disclosure of this application and are hereby incorporated by reference in their entireties.

FIELD

The present disclosure relates generally to articles of footwear having a dynamic lacing system for moving footwear between a tightened state and a loosened state.

BACKGROUND

This section provides background information related to the present disclosure which is not necessarily prior art.

Articles of footwear conventionally include an upper and a sole structure. The upper may be formed from any suitable material(s) to receive, secure and support a foot on the sole structure. A bottom portion of the upper, proximate to a bottom surface of the foot, attaches to the sole structure. Sole structures generally include a layered arrangement extending between an outsole providing abrasion-resistance and traction with a ground surface and a midsole disposed between the outsole and the upper for providing cushioning for the foot.

The upper may cooperate with laces, straps, or other fasteners to adjust the fit of the upper around the foot. For instance, laces may be tightened to close the upper around the foot and tied once a desired fit of the upper around the foot is attained. Care is required to ensure that the upper is not too loose or too tight around the foot each time the laces are tied. Moreover, the laces may loosen or become untied during wear of the footwear. While fasteners such as hook and loop fasteners are easier and quicker to operate than traditional laces, these fasteners have a propensity to wear out over time and require more attention to attain a desired tension when securing the upper to the foot.

Known automated tightening systems typically include a tightening mechanism, such as a rotatable knob, that can be manipulated to apply tension to one or more cables that interact with the upper for closing the upper around the foot. While these automated tightening systems can incrementally increase the magnitude of tension of the one or more cables to achieve the desired fit of the upper around the foot, they require a time-consuming task of manipulating the tightening mechanism to properly tension the cables for securing the upper around the foot. Further, when it is desired to remove the footwear from the foot, the wearer is required to simultaneously depress a release mechanism and pull the upper away from the foot to release the tension of the cables. Further yet, these automated tightening systems provide a constant tensioning along the lengths of the one or more cables, whereby rotation of the rotatable knob causes the entire cable to be tightened uniformly. In instances where it may be desirable to tighten a first region of the upper to a different degree than a second region of the upper, additional cables and tightening mechanisms must be incorporated and controlled separately.

Thus, known automated tightening systems lack suitable provisions for quickly and variably adjusting the fit of an upper around a foot during both tightening and loosening of the footwear. Moreover, the tightening mechanism employed by these known automated tightening systems is required to be incorporated onto an exterior of the upper so that the tightening mechanism is accessible to the wearer for adjusting the fit of the upper around the foot, thereby detracting from the general appearance and aesthetics of the footwear.

DRAWINGS

The drawings described herein are for illustrative purposes only of selected configurations and are not intended to limit the scope of the present disclosure.

Figure 10:
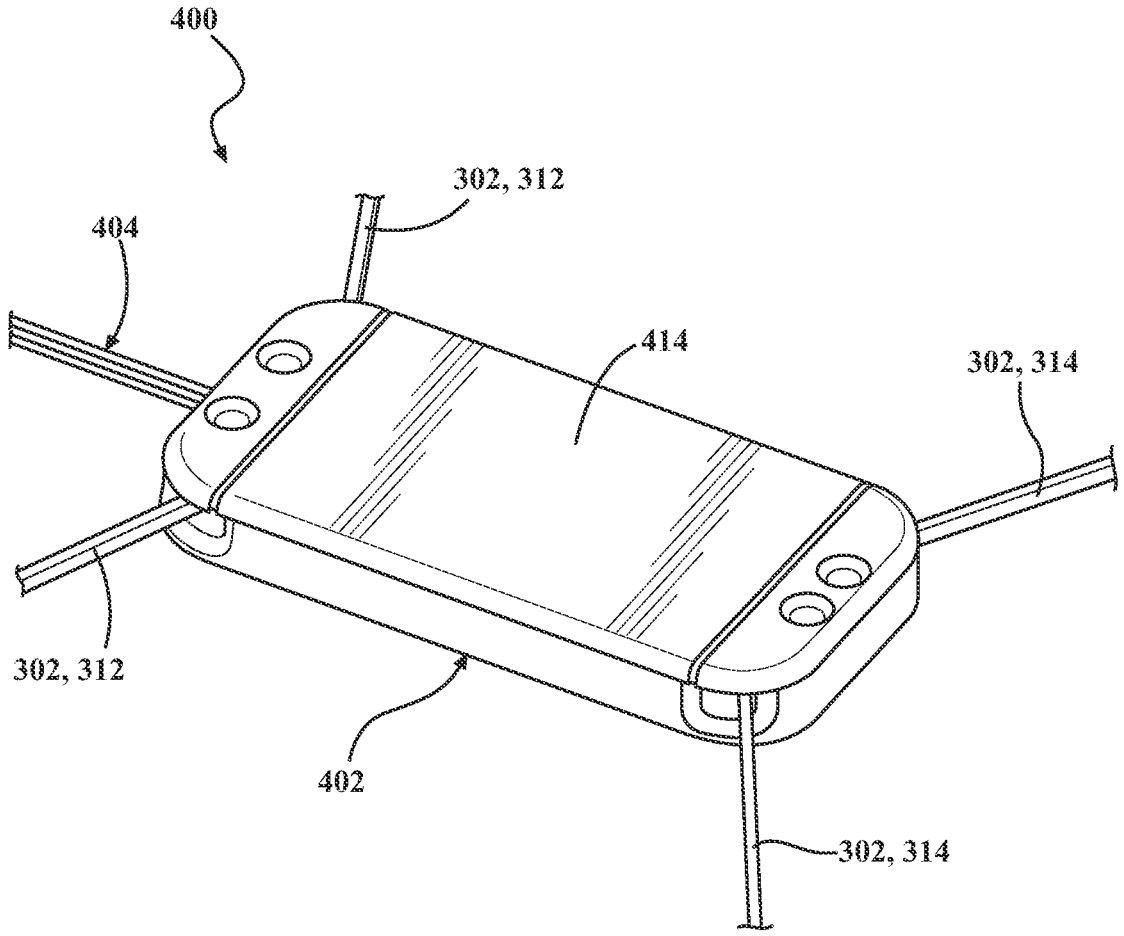
FIG. 10 is a perspective view of an example of a cable lock according to the principles of the present disclosure.
Figure 12:
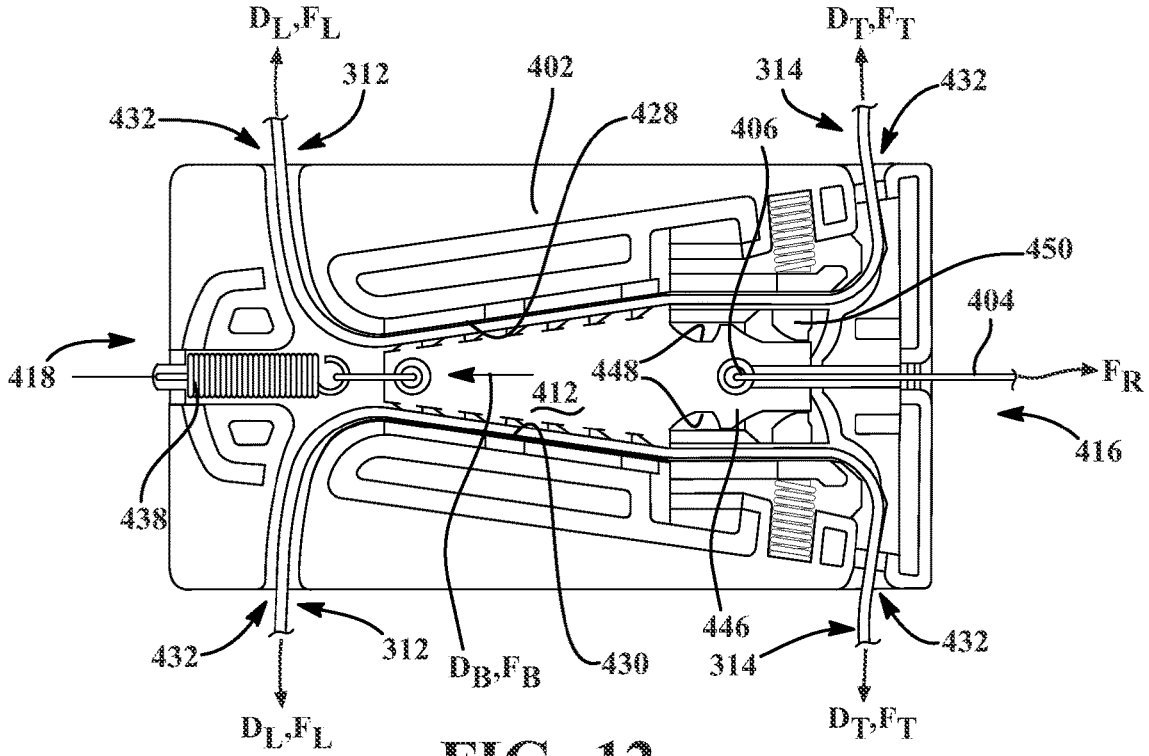
Figure 13:
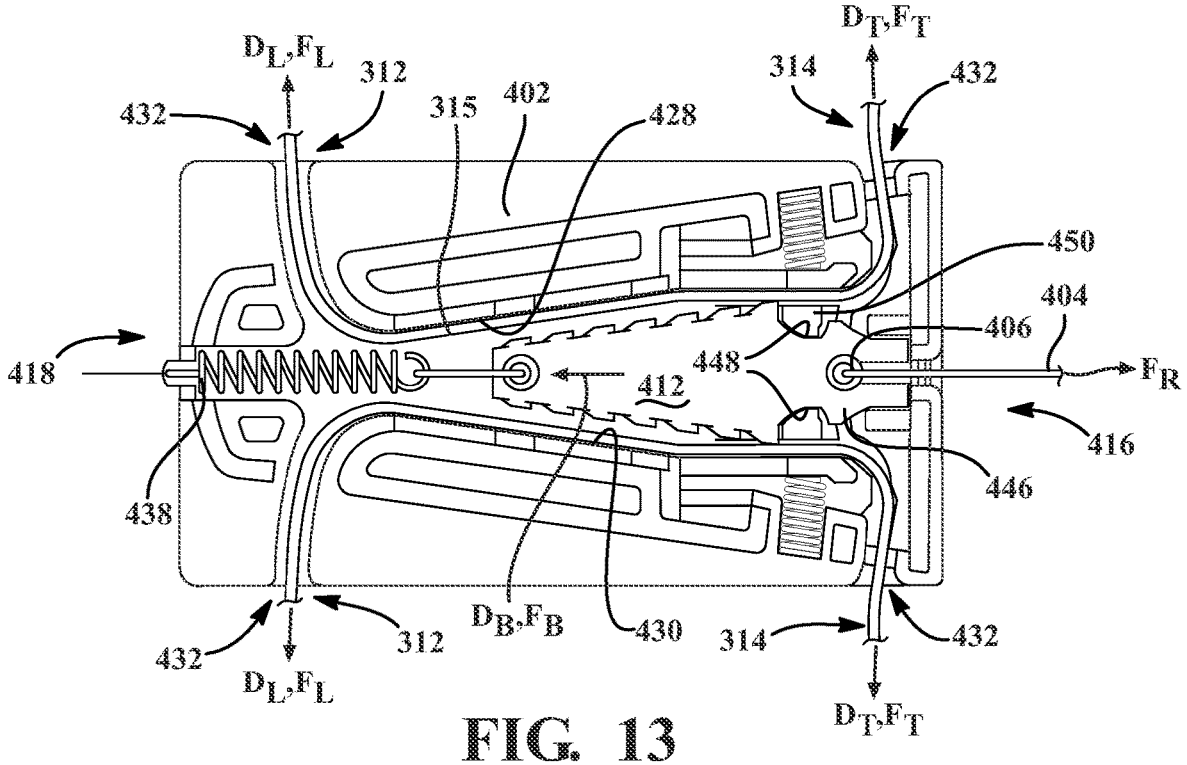

FIG. 12 is top view of the cable lock of FIG. 10, showing a housing having a lid removed to expose a locking member slidably disposed within the housing when the locking member is in a locked position; and FIG. 13 is a top view of the locking device of FIG. 10, showing a housing having a lid removed to expose a locking member slidably disposed within the housing when the locking member is in an unlocked position.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an article of footwear. The article of footwear includes an upper and a sole structure attached to the upper. The article of footwear also includes a cradle having a base extending between the upper and the sole structure, a first sidewall extending from the base and along a first side of the upper, and a second sidewall extending from the base along a second side of the upper. Each of the first sidewall and the second sidewall includes a plurality of eyelets. The article of footwear further includes a cable operable to move the upper between a relaxed state and a tightened state. The cable including a first strand extending through at least one of the eyelets of the first sidewall and a second strand extending through at least one of the eyelets of the second sidewall.

Implementations of the disclosure may include one or more of the following optional features. In some implementations, at least one of the first sidewall and the second sidewall includes a first cable channel, a first portion of the cable being routed through the first cable channel. The at least one of the first sidewall and the second sidewall may include a second cable channel, a second portion of the cable being routed through the second cable channel. The first cable channel may intersect the second cable channel. The second cable channel may include a sleeve disposed therein, the sleeve configured to receive the second portion of the cable. The first cable channel may include a portion of a sheath disposed therein, the sheath configured to receive the first portion of the cable. The cradle may be formed of either a rigid material or a semi-rigid material, or a combination of a rigid material and a semi-rigid material.

In some examples, the article of footwear includes a cable lock operable to selectively permit movement of the cable in a loosening direction. Here, the cable lock may be disposed between the base of the cradle and a portion of the sole structure. Additionally or alternatively, the cable lock may be partially received within the base of the cradle. Optionally, the base of the cradle may include one of either a recess or a through-hole that receives at least a portion of the cable lock.

In some configurations, the base of the cradle is disposed within the sole structure. Additionally or alternatively, the cradle may be disposed in a mid-foot region of the article of footwear. The first side of the upper may be a lateral side and the second side of the upper may be a medial side.

In some implementations, the article of footwear includes a forefoot strap extending over the upper from a first end to a second end, the first strand attached to the first end of the forefoot strap and the second strand attached to the second end of the forefoot strap. The article of footwear may also include a heel strap extending around a heel counter of the upper from a first end to a second end, the first strand attached to the first end of the heel strap and the second strand attached to the second end of the heel strap. An end of the first strand may be attached to the first sidewall and an end of the second strand may be attached to the second sidewall. The first sidewall and the second sidewall may be arcuate. The base, the first sidewall, and the second sidewall may cooperate to define a channel, the upper being disposed within the channel. At least one of the first sidewall and the second sidewall may include an elongate channel operable to receive one of the first strand and the second strand.

Another aspect of the disclosure provides a cradle for an article of footwear. The cradle includes a base and a first sidewall extending from a first side of the base to a first distal end and including a first plurality of eyelets. The cradle also includes a second sidewall extending from a second side of the base to a second distal end and including a second plurality of eyelets.

This aspect may include one or more of the following optional features. In some examples, the base, the medial sidewall, and the lateral sidewall cooperate to define a first channel extending along a length of the cradle and configured to receive an upper of an article of footwear therein. At least one of the first sidewall and the second sidewall may be arcuate. The base may be substantially planar and each of first sidewall and the second sidewall may be arcuate. At least one of the first distal end and the second distal end may converge with the base along a direction from a first end of the cradle to a second end of the cradle. A height of at least one of the first sidewall and the second sidewall may taper along a direction from a first end of the cradle to a second end of the cradle.

In some configurations, at least one of the first sidewall and the second sidewall includes a first cable channel configured to receive a first portion of a cable. The at least one of the first sidewall and the second sidewall includes a second cable channel configured to receive a second portion of a cable. The first cable channel may intersect the second cable channel. The second cable channel may be configured to receive a sleeve therein, the sleeve configured to receive the second portion of the cable. The first cable channel may be configured to receive a sheath therein, the sheath configured to receive the first portion of the cable. The base may include one of either a recess or a through-hole configured to receive at least a portion of a cable lock therein. The recess may be formed in an outer surface of the base. The first cable channel may extend from the recess to the first distal end of the first sidewall. The second cable channel may extend from the recess to a posterior end of the first sidewall.

In some implementations, at least one of the plurality of the eyelets is elongate. Optionally, at least one of the eyelets may be cylindrical. At least one of the eyelets may include a flange circumscribing the eyelet. Here, the flange may be formed on an outer surface of the cradle. Additionally or alternatively, the flange may have a uniform height or the flange may have a variable height. The base may include a tab extending from a posterior end of the base. The tab may include a groove extending from the recess of the base to a posterior end of the tab. The cradle may be formed of a rigid material or a semi-rigid material, or a combination of a rigid material and a semi-rigid material.

The details of one or more implementations of the disclosure are set forth in the accompanying drawings and the description below. Other aspects, features, and advantages will be apparent from the description and drawings, and from the claims.

Referring to FIGS. 1A-2B, an example of an article of footwear 10 including a system providing for variable tension is disclosed. In some implementations, the article of footwear 10 includes an upper 100 and a sole structure 200 attached to the upper 100. The article of footwear 10 further includes a tensioning system 300 and a cable lock 400 each integrated into at least one of the upper 100 and the sole structure 200. The tensioning system 300 includes a cable 302 and a cradle 304, which provides a plurality of passages and guides for routing portions of the cable 302 along the upper 100, the sole structure 200, and the cable lock 400. The tensioning system 300 and the cable lock 400 cooperate to move the article of footwear 10 between a relaxed state and a tightened state. The cable lock 400 is configured to selectively secure the cable 302 in the tightened state.

The footwear 10 may further include an anterior end 12 associated with a forward-most point of the footwear 10, and a posterior end 14 corresponding to a rearward-most point of the footwear 10. As shown in the top view of FIG. 3, a longitudinal axis $A_F$ of the footwear 10 extends along a length of the footwear 10 from the anterior end 12 to the posterior end 14, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14.

The article of footwear 10 may be divided into one or more regions along the longitudinal axis $A_F$. The regions may include a forefoot region 20, a mid-foot region 22 and a heel region 24. The forefoot region 20 may correspond with toes and joints connecting metatarsal bones with phalanx bones of a foot. The mid-foot region 22 may correspond with an arch area of the foot, and the heel region 24 may correspond with rear regions of the foot, including a calcaneus bone.

The upper 100 includes a plurality of components that cooperate to define an interior void 102 and an ankle opening 104, which cooperate to receive and secure a foot for support on the sole structure 200. For example, the upper 100 includes a pair of quarter panels 106 in the mid-foot region 22 on opposite sides of the interior void 102. A throat 108 extends across the top of the upper 100 and defines an instep region extending between the quarter panels 106 from the ankle opening 104 to the forefoot region 20. In the illustrated example, the throat 108 is enclosed, whereby a material panel extends between the opposing quarter panels in the instep region to cover the interior void 102. Here, the material panel covering the throat 108 may be formed of a material having a higher modulus of elasticity than the material forming the quarter panels 106.

The upper 100 may be further described as including heel side panels 110 extending through the heel region 24 along the lateral and medial sides 16, 18 of the ankle opening 104. A heel counter 112 wraps around the posterior end 14 of the footwear 10 and connects the heel side panels 110. Uppermost edges of the throat 108, the heel side panels 110, and the heel counter 112 cooperate to form a collar 114, which defines the ankle opening 104 of the interior void 102.

The upper 100 may further include one or more grip features 116 attached to the collar 114 adjacent the ankle opening 104 for pulling the footwear 10 onto and off of the foot. As illustrated best in FIGS. 1A-2B, the upper 100 may be provided with one or more shrouds 118 for concealing the various components of the tensioning system 300. For example, the upper 100 may include a throat shroud 118 configured to conceal the throat 108 and portions of the tensioning system 300 associated with the throat 108.

The upper 100 may be formed from one or more materials that are stitched or adhesively bonded together to define the interior void 102. Suitable materials of the upper 100 may include, but are not limited to, textiles, foam, leather, and synthetic leather. The example upper 100 may be formed from a combination of one or more substantially inelastic or non-stretchable materials and one or more substantially elastic or stretchable materials disposed in different regions of the upper 100 to facilitate movement of the upper 100 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

In the illustrated example, at least one of the heel side panels 110 includes an elastic region 120 extending from the collar 114 towards the sole structure 200. As shown, the elastic region 120 terminates at an intermediate portion of each of the heel side panels 110, between the collar 114 and the sole structure 200. In other examples, the elastic region 120 may extend continuously and entirely from the collar 114 to the sole structure 200. The elastic region 120 allows the heel counter 112 to be pulled apart from the throat 108 to selectively expand the size of the ankle opening 104.

The upper 100 further includes a rigid heel clip 122 attached to the heel counter 112. The heel clip 122 includes a groove 124 extending continuously around the heel counter 112 from the lateral side 16 to the medial side 18. As described in greater detail below, the groove 124 of the clip 122 is configured to receive a heel strap 310 of the tensioning system 300. As best shown in the cross-sectional view of FIG. 4, the heel clip 122 may also include a channel 126 for receiving and securing an end of a release mechanism 404 of the cable lock 400 when the article of footwear 10 is assembled.

The sole structure 200 includes a midsole 202 configured to provide cushioning characteristics to the sole structure 200, and an outsole 204 configured to provide the ground-engaging surface 26 of the article of footwear 10. Unlike conventional sole structures, each of the midsole 202 and the outsole 204 are formed compositely, whereby each is formed of multiple subcomponents. For example, with reference to FIGS. 4-7, the midsole 202 includes a carrier 206, a lower core 208 disposed within the carrier 206, and an upper core 210 disposed within the carrier 206 (collectively "the midsole components 206, 208, 210"). Likewise, the outsole 204 includes a forefoot portion 212 and a heel portion 214 formed separately from the forefoot portion 212. The subcomponents 206, 208, 210, 212, 214 are assembled and secured to each other using various methods of bonding, including adhesively bonding and melding, for example.

Figure 7:
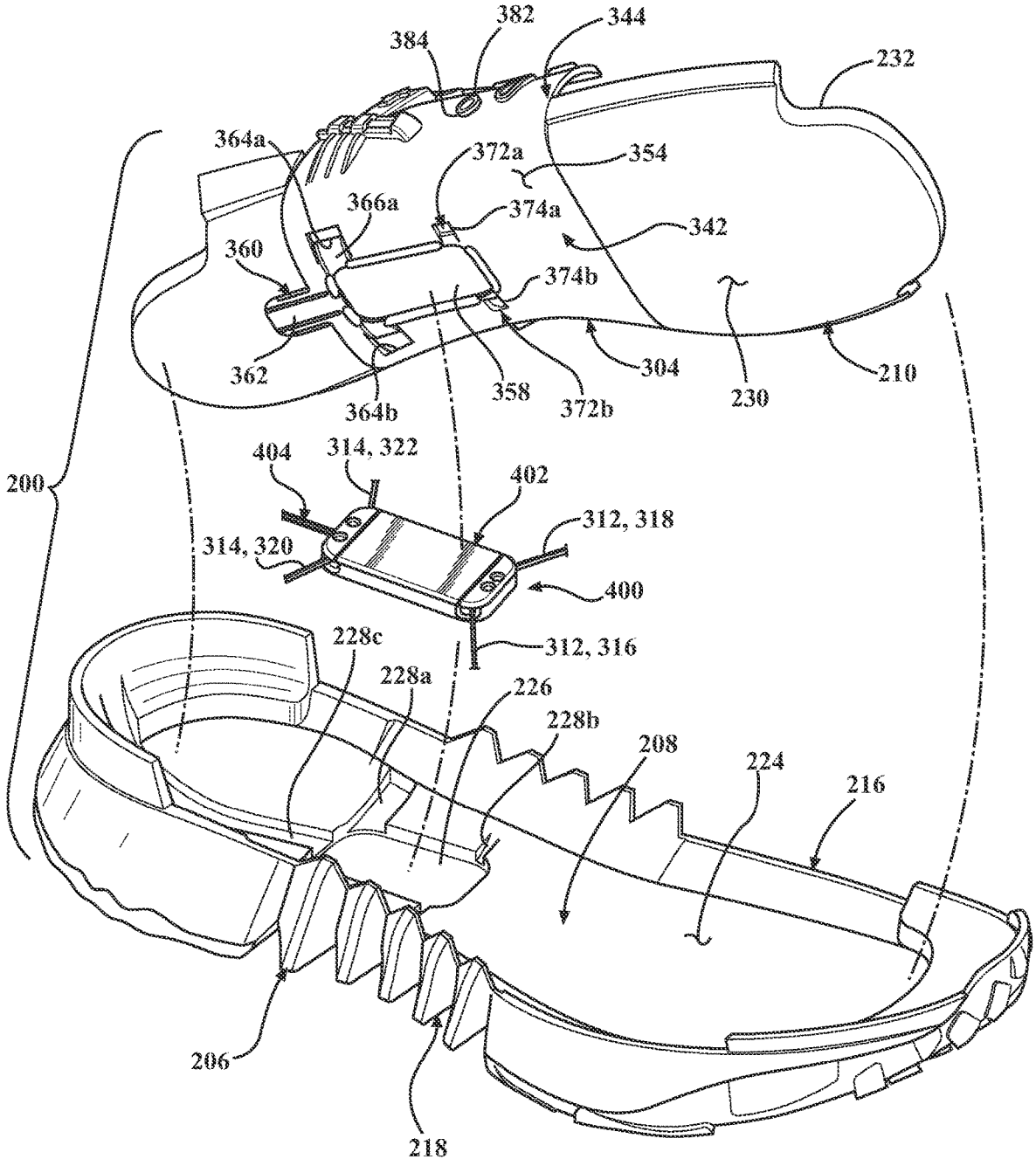
FIG. 7 is an exploded view of a sole structure of the article of footwear of FIG. 1A.

As shown, the carrier 206 forms an exterior portion of the sole structure 200, and includes a peripheral wall 216 and a base 218 cooperating to define an interior cavity 220 extending from the forefoot region 20 to the heel region 24. The lower core 208 is disposed within the interior cavity 220, and includes a lower surface 222 facing the base 218 and an upper surface 224 formed on an opposite side of the lower core 208 from the lower surface 222. As shown in FIG. 7, the upper surface 224 includes a recess 226 and a plurality of notches 228*a*-228*c* for receiving the tensioning system 300 and the cable lock 400. Particularly, the recess 226 is configured to receive a lower portion of a housing 402 of the cable lock 400, such that the cable lock 400 is at least partially embedded within the upper surface 224 of the lower core 208. The notches 228*a*-228*c* extend outwardly from the recess 226 along the upper surface 224 of the carrier 206 and are configured to receive portions of the tensioning system 300 and the cable lock 400.

The upper core 210 is disposed within the interior cavity 220, and includes a lower surface 230 facing the upper surface 224 of the lower core 208 and an upper surface 232 formed on an opposite side of the upper core 210 from the lower surface 230. The lower surface 230 of the upper core 210 includes a channel 234 extending from the lateral side 16 to the medial side 18, and configured to receive the cradle 304 therein, whereby a bottom surface of the cradle 304 is substantially flush with the lower surface 230 of the upper core 210. The upper surface 232 of the upper core 210 cooperates with the peripheral wall 216 to form a footbed 28 of the article of footwear 10.

Each of the midsole components 206, 208, 210 is formed of a resilient polymeric material, such as foam or rubber, to impart properties of cushioning, responsiveness, and energy distribution to the foot of the wearer. In some examples, the carrier 206 is formed of a first foam material, the lower core 208 is formed of a second foam material, and the upper core 210 is formed of a third foam material. For example, one or more of the midsole components 206, 208, 210 may be formed of foam materials providing greater cushioning and impact distribution, while other of the midsole components 206, 208, 210 are formed of a foam material having a greater stiffness.

Example resilient polymeric materials for the midsole components 206, 208, 210 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The tensioning system 300 includes the cable 302 and a plurality of routing elements 304, 306, 308, 310 configured to route the cable 302 through the sole structure 200 and along the upper 100. The routing elements 304, 306, 308, 310 include the cradle 304 configured to provide routing and attachment points for the cable 302 in a mid-foot region of the article of footwear 10. As described in greater detail below, a portion of the cable 302 may be received within an elastic sheath 306 that extends along an exterior surface of the upper 100 and is operable to maintain the cable 302 against the upper 100 when the article of footwear 10 is moved to the tightened state. The routing elements 308, 310 further include one or more forefoot straps 308 extending over the throat 108 of the upper 100, and one or more heel straps 310 extending around the heel counter 112.

The cable 302 may be highly lubricous and/or may be formed from one or more fibers having a low modulus of elasticity and a high tensile strength. For instance, the fibers may include high modulus polyethylene fibers having a high strength-to-weight ratio and a low elasticity. Additionally or alternatively, the cable 302 may be formed from a molded monofilament polymer and/or a woven steel with or without other lubrication coating. In some examples, the cable 302 includes multiple strands of material woven together.

With reference to FIGS. 1A-2B, the cable 302 includes a tensioning element 312 and a control element 314 that cooperate with the routing elements 304, 306, 308, 310 and the cable lock 400 to move the article of footwear 10 between the tightened state and the relaxed state. The tensioning element 312 and the control element 314 may be collectively referred to as adjustment elements 312, 314. The adjustment elements 312, 314 are movable in a tightening direction $D_T$ to move the article of footwear 10 into the tightened state, and in a loosening direction $D_L$ to allow the article of footwear 10 to transition to a relaxed state. In some examples, a tightening force $F_T$ applied to the control element 314 is transmitted to at least a portion of the tensioning element 312 through the cable lock 400 to move the tensioning element 312 in the tightening direction $D_T$.

Figure 1A:
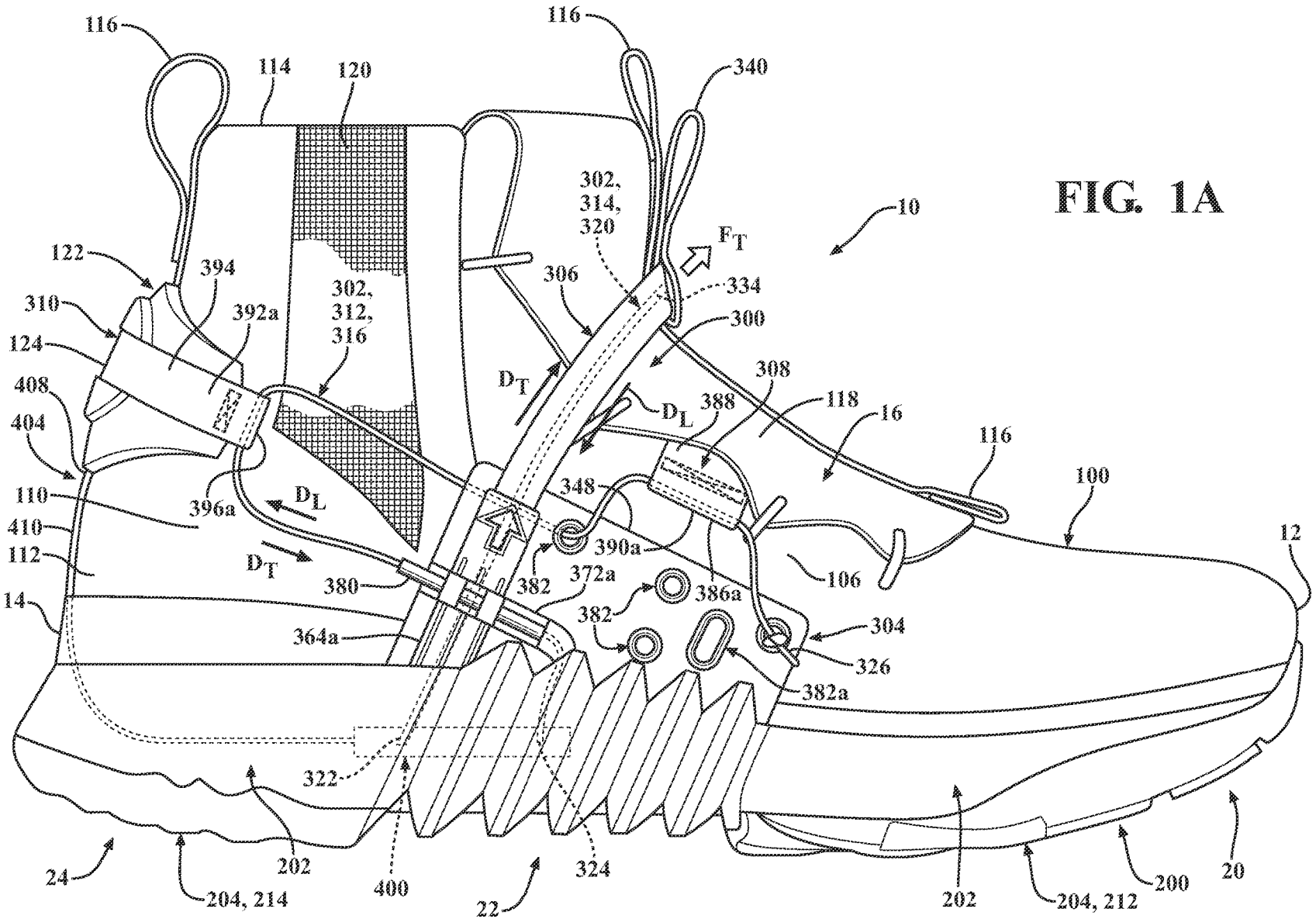
FIG. 1A is a lateral-side elevation view of an article of footwear in accordance with principles of the present disclosure, showing the article of footwear in a relaxed state.
Figure 1B:
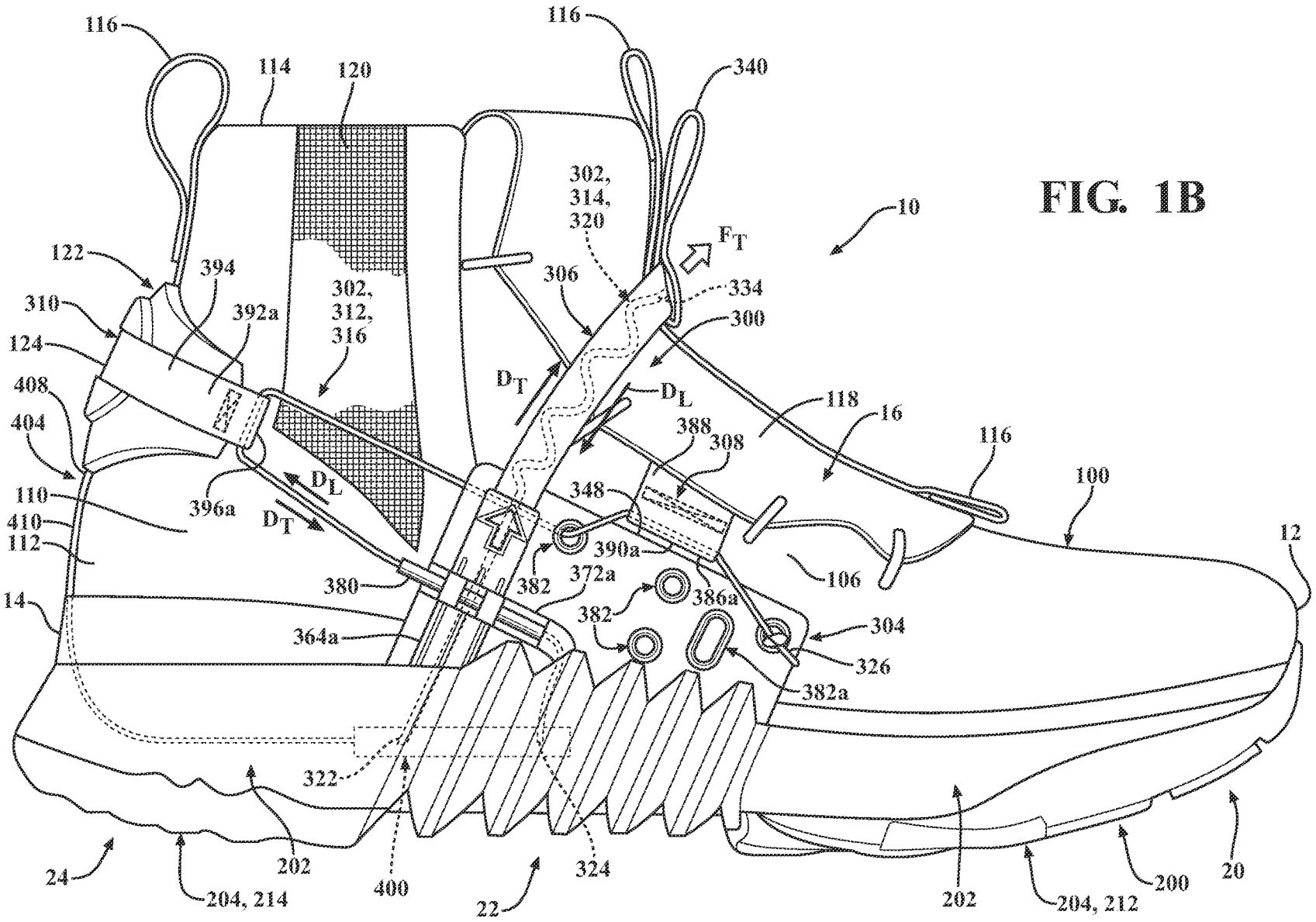
FIG. 1B is a lateral-side elevation view of the article of footwear of FIG. 1A, showing the article of footwear in a tightened state.
Figure 2A:
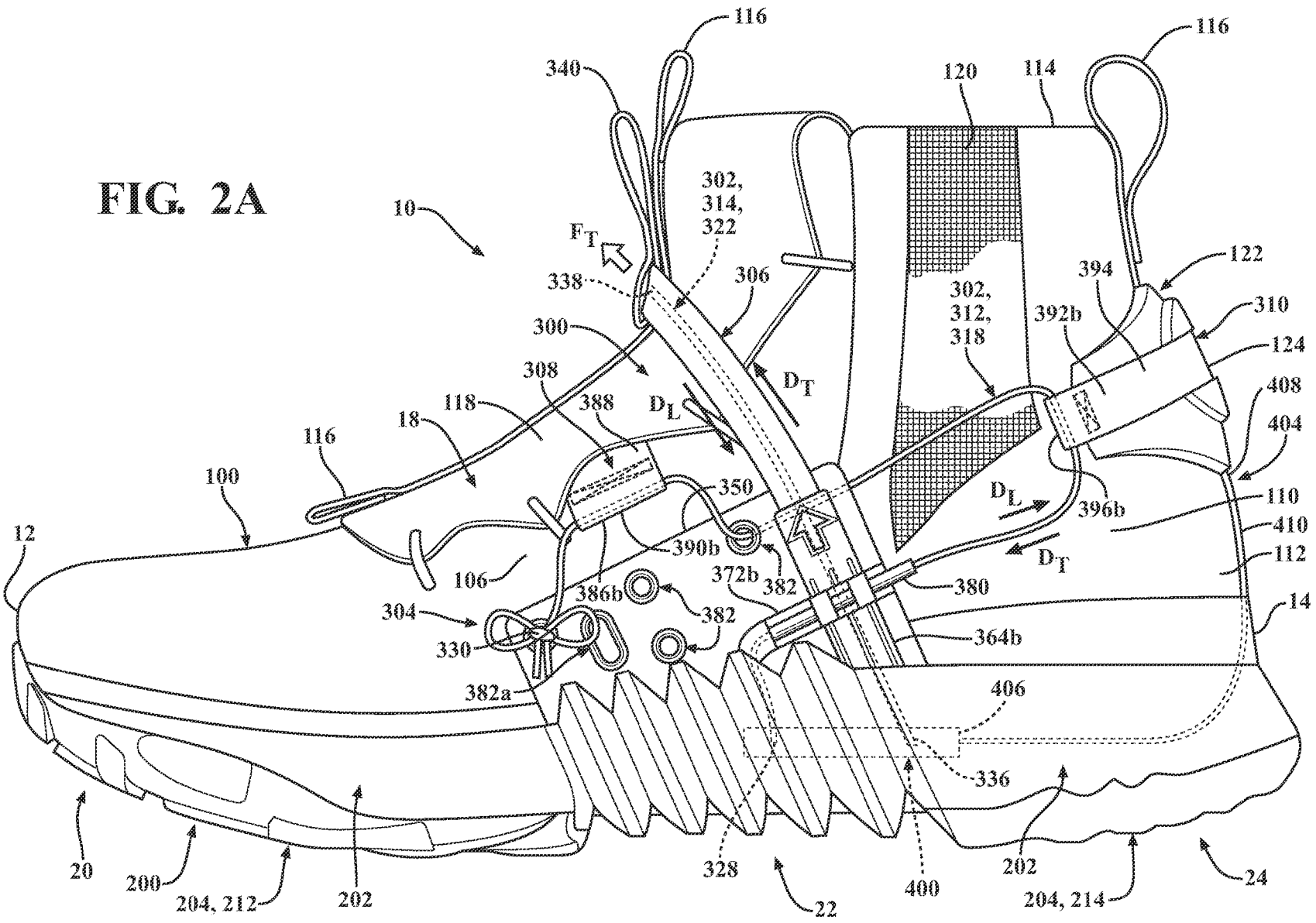
FIG. 2A is a medial-side elevation view of the article of footwear of FIG. 1A, showing the article of footwear in the relaxed state.
Figure 2B:
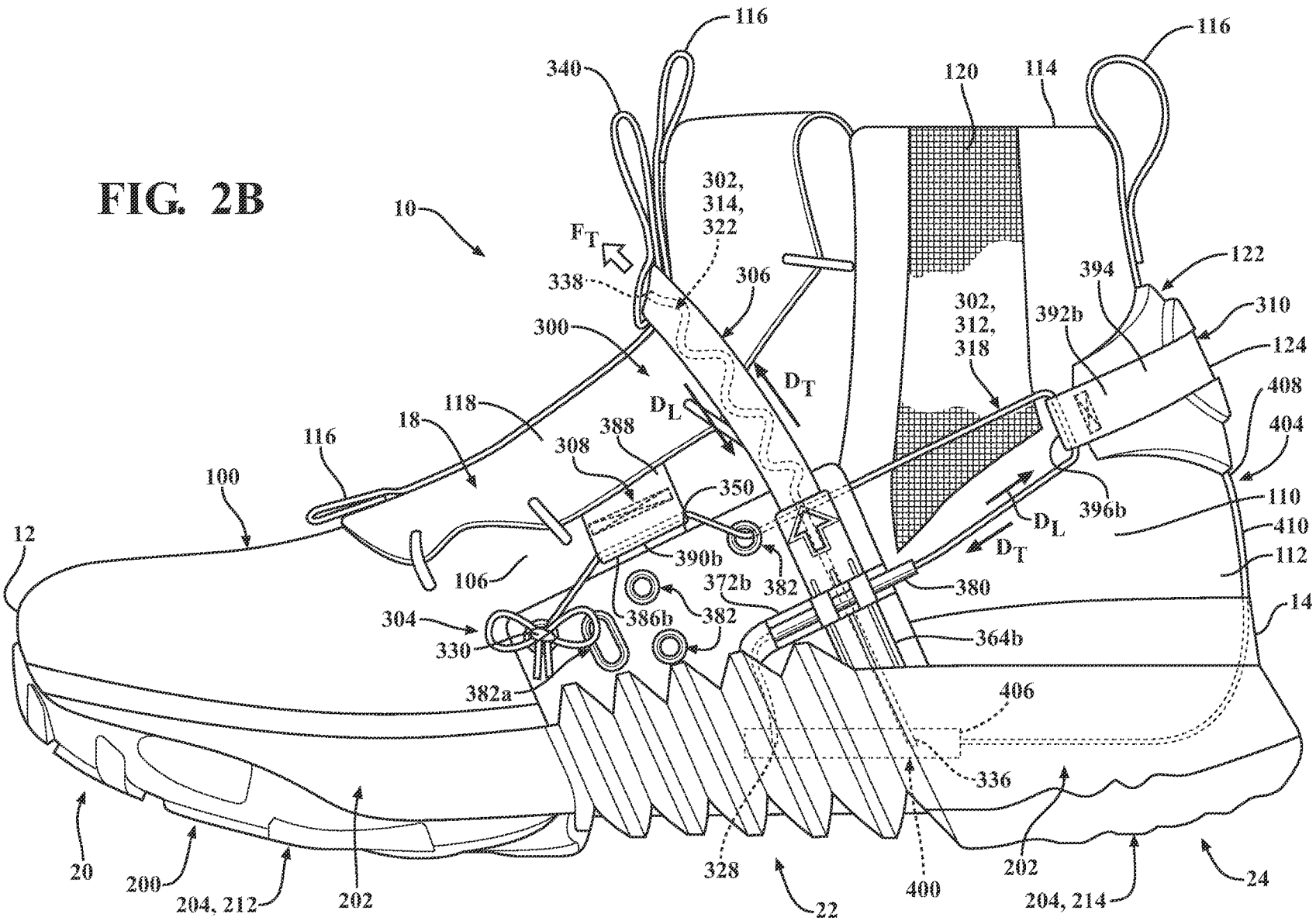
FIG. 2B is a medial-side elevation view of the article of footwear of FIG. 1A, showing the article of footwear in the tightened state.

As best shown in FIGS. 1A-2B, the tensioning element 312 and the control element 314 may be described as including lateral strands 316, 320 and medial strands 318, 322. Particularly, the tensioning element 312 includes a lateral strand 316 and a medial strand 318. Likewise, the control element 314 also includes a lateral strand 320 and a medial strand 322. In the illustrated example, the lateral strand 316 of the tensioning element 312 is connected to the lateral strand 320 of the control element 314 through the cable lock 400, as shown in FIGS. 1A and 1B. Similarly, the medial strand 318 of the tensioning element 312 is connected to the medial strand 322 of the control element 314 through the cable lock 400, as shown in FIGS. 2A and 2B. Accordingly, positions of the lateral and medial strands 316, 318 of the tensioning element 312 may be adjusted by moving a respective one of the lateral and medial strands 320, 322 of the control element 314.

With reference to FIGS. 1A and 1B, the lateral strand 316 of the tensioning element 312 extends from a first end 324 at the cable lock 400 and is routed along the lateral side 16 of the upper 100 through the cradle 304, the heel strap 310, and the forefoot strap 308 to a second end 326 attached to the cradle 304. Referring to FIGS. 2A and 2B, the medial strand 318 of the tensioning element 312 extends from a first end 328 at the cable lock 400 and is routed along the medial side 18 of the upper 100 through the cradle 304, the heel strap 310, and the forefoot strap 308 to a second end 330 attached to the cradle 304.

Figure 3:
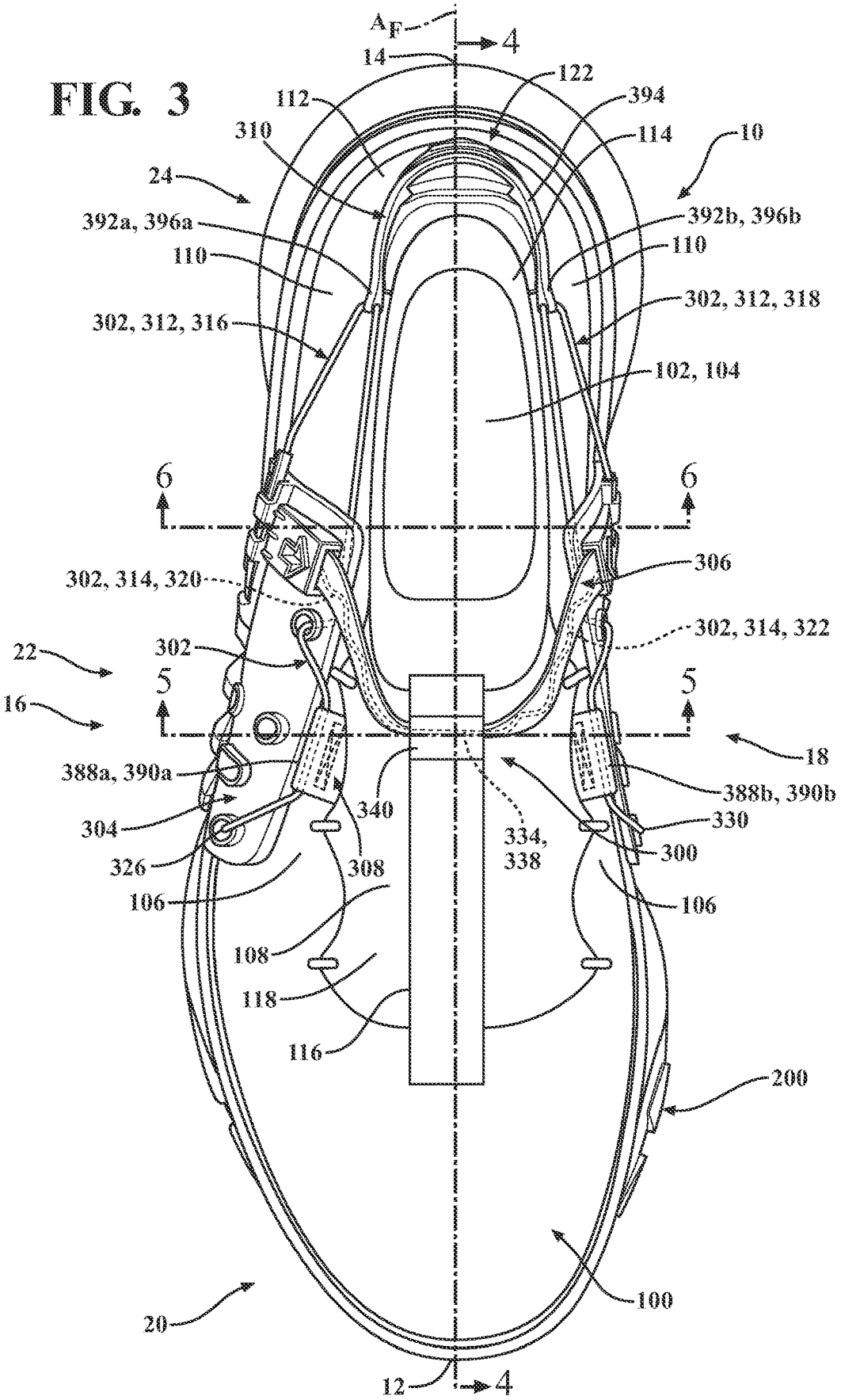
FIG. 3 is a top plan view of the article of footwear of FIG. 1A.

As described above and shown in FIGS. 1A and 1B, the lateral strand 320 of the control element 314 is connected to the lateral strand 316 of the tensioning element 312 through the cable lock 400, and extends from a first end 332 at the cable lock 400 to a second end 334 along the upper 100. Likewise, as shown in FIGS. 2A and 2B, the medial strand 322 of the control element 314 is connected to the medial strand 318 of the tensioning element 312 through the cable lock 400, and extends from a first end 336 at the cable lock 400 to a second end 338 along the upper 100. Referring to FIG. 3, the second end 330 of the lateral strand 320 may be connected to the second end 334 of the medial strand 322, such that the lateral strand 320 and the medial strand 322 form a continuous strand extending over the throat 108 of the upper 100. In other examples, the second ends 334, 338 of the lateral strand 320 and the medial strand 322 may be indirectly connected to each other by an intermediate connecting element (not shown).

A portion of the control element 314 that extends around the upper 100 may be enclosed within one or more of the sheaths 306. Each sheath 306 may be formed from a material and/or a weave that allows the sheath 306 and the control element 314 to move from a relaxed state to a stretched or expanded state when the control element 314 is moved in a direction away from the upper 100 by way of the tightening force $F_T$ (i.e., when the control element 314 is moved in the tightening direction $D_T$). When the tightening force $F_T$ is removed, the material and/or weave of the sheath 306 automatically causes the sheath 306 to contract to the relaxed state and accommodate bunching by the control element 314 therein, as shown in FIGS. 1B and 2B. With reference to FIG. 3, the control element 314 is routed through the sheath 306 and over the throat 108 of the upper 100, adjacent to an anterior side of the ankle opening 104.

Accordingly, the control element 314 extends across the upper 100 in front of the ankle of the wearer.

In the example shown, a separate tightening grip 340 may operatively connect to the sheath 306 at an attachment location proximate to the throat 108 to allow a user to apply the tightening force $F_T$ to pull the control element 314 away from the upper 100, thereby causing each of the control element 314 and the tensioning element 312 to move in the tightening direction $D_T$. Other configurations may include operatively connecting one or more tightening grips 340 to other portions of the sheath 306 along the length of the control element 314. In some implementations, the tightening grip 340 is omitted and the sheath 306 is gripped directly by the user.

Figure 8:
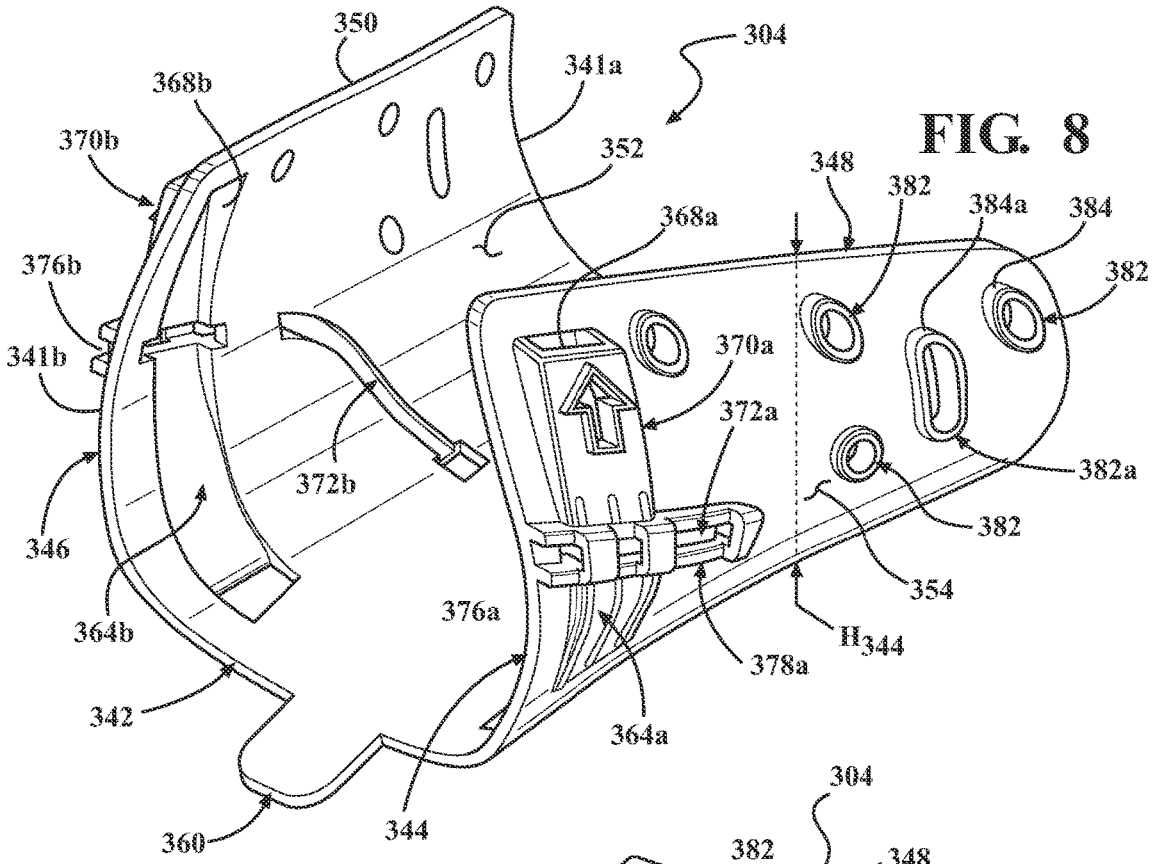
FIG. 8 is a lateral-side perspective view of a cradle of the article of footwear of FIG. 1A.
Figure 9:
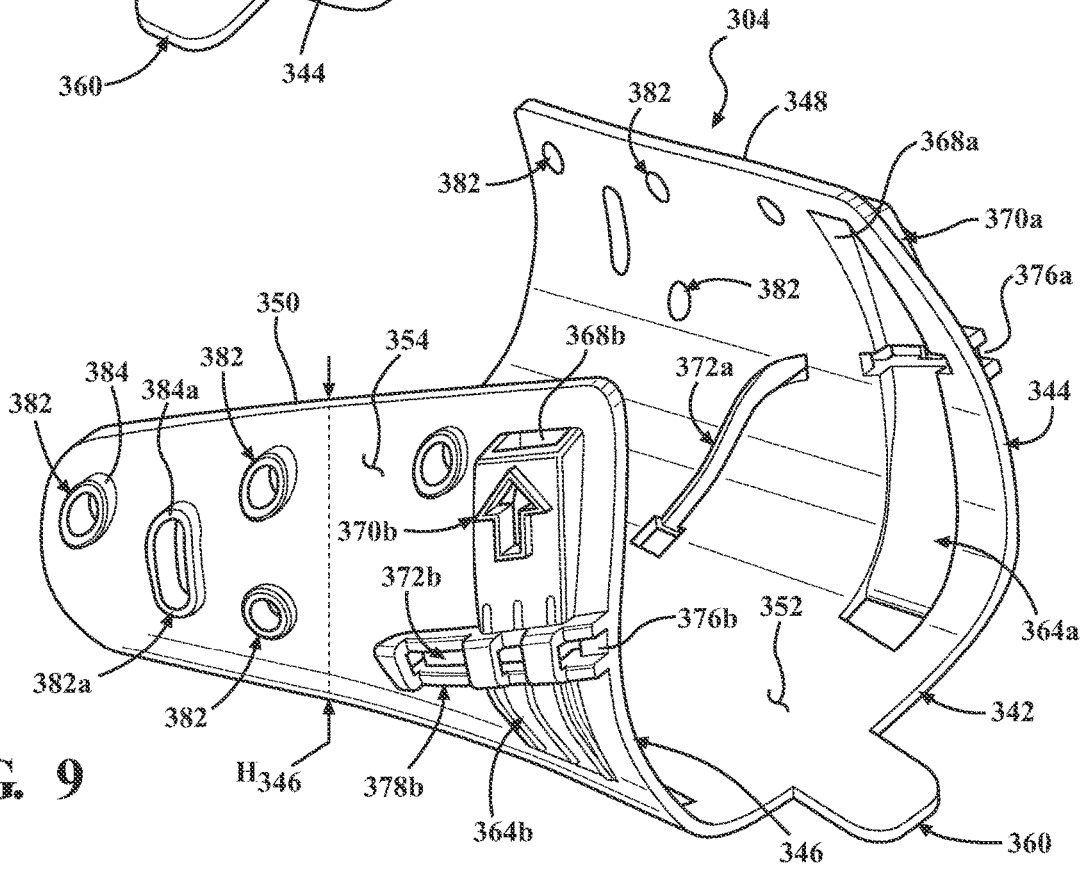
FIG. 9 is a medial-side perspective view of the cradle of FIG. 8.

Referring now to FIGS. 7-9, the cradle 304 of the tensioning system 300 is configured to provide a unitary structure including a plurality of features for receiving, routing, and/or attaching the cable 302, the sheath 306, and the cable lock 400. The cradle 304 is formed of a rigid or semi-rigid material having a greater hardness than the materials of the upper 100. Accordingly, in addition to providing for routing and mounting points for the cable 302, the cradle 304 may also be configured to provide regions of increased stiffness along the article of footwear 10, as described in greater detail below.

The cradle 304 extends from an anterior end 341*a* to a posterior end 341*b*, and includes a base 342, a lateral sidewall 344 extending from the lateral side 16 of the base 342, and a medial sidewall 346 extending from the medial side 18 of the base 342. The lateral sidewall 344 extends from the lateral side 16 of the base 342 to a lateral distal end 348, and the medial sidewall 346 extends from the medial side 18 of the base 342 to a medial distal end 350. Heights $H_{344}$, $H_{346}$ of each of the sidewalls 344, 346 taper along a direction of the longitudinal axis $A_F$ from the posterior end 341*b* to the anterior end 341*a*.

Figure 4:
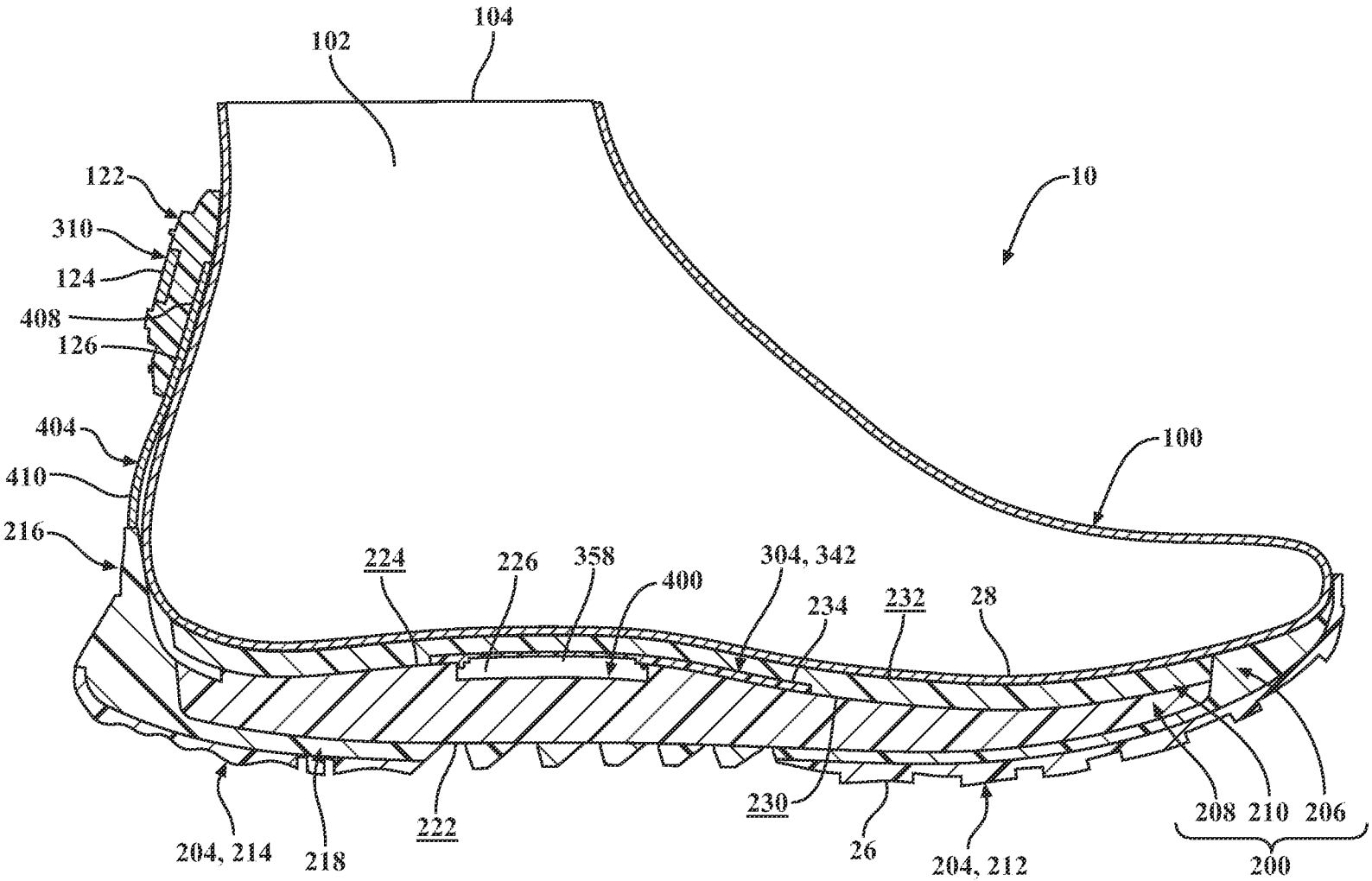
FIG. 4 is a cross-sectional view of the article of footwear of FIG. 1A, taken along line 4-4 of FIG. 3.

The base 342 and the sidewalls 344, 346 cooperate to form a substantially continuous inner surface 352 and an outer surface 354 formed on an opposite side of the cradle 304 from the inner surface 352. The base 342 of the cradle 304 is substantially planar and is configured to be received within the channel 234 formed in the lower surface 230 of the upper core 210, whereby the outer surface 354 of the cradle 304 is flush with the lower surface 230 of the upper core 210, as best shown in FIGS. 4 and 7. Each of the sidewalls 344, 346 has an arcuate shape from the base 342 to the respective distal end 348, 350. Particularly, the inner surface 352 of each of the sidewalls 344, 346 is concave. Accordingly, the inner surface 352 of the cradle 304 defines a U-shaped channel 356 configured to receive the mid-foot region 22 of the upper 100 therein, whereby the base 342 extends beneath the upper 100 and the sidewalls 344, 346 extend along the respective lateral and medial quarter panels 106.

The base 342 further includes a first plurality of routing and receiving features configured to accommodate the cable 302 and the cable lock 400. For example, the base 342 includes a recess 358 formed in the outer surface 354. The recess 358 has a profile corresponding to a shape of the housing 402 of the cable lock 400 and is configured to oppose the recess 226 formed in the upper surface 224 of the lower core 208 when the article of footwear 10 is assembled. Accordingly, the recess 226 of the lower core 208 receives a lower portion of the housing 402 of the cable lock 400 and the recess 358 of the cradle 304 receives an upper portion of the housing 402 of the cable lock 400. As such, the housing 402 is completely disposed within the two recesses 226, 358, as best shown in FIG. 4.

The base 342 may include a tab 360 extending from the posterior end 341*b* of the base 342. As best shown in FIG. 7, the tab 360 may include a groove 362 extending from a posterior edge of the recess 358 to a posterior edge of the tab 360. The groove 362 opposes one of the notches 228*c* formed in the upper surface 224 of the lower core 208 to provide a routing path for a release mechanism 404 of the cable lock 400. Particularly, the groove 362 provides a routing path for the release mechanism 404 immediately adjacent to the cable lock 400, thereby preventing the release mechanism 404 from being compressed or cinched at the cable lock 400.

With continued reference to FIGS. 8 and 9, the cradle 304 includes a pair of control element channels 364*a*, 364*b* configured to provide a routing path for the control element 314 from the cable lock 400 to the upper 100. Particularly, the control element channels 364*a*, 364*b* are configured to slidably route ends of the sheath 306 from the upper 100 to the cable lock 400.

A lateral control element channel 364*a* extends from a first end 366*a* formed in the outer surface 354 of the base 342 as shown in FIG. 7. The first end 366*a* is formed at a lateral edge of the recess 358, adjacent a posterior end of the recess 358, and opposes one of the notches 228*a* formed in the upper surface 224 of the lower core 208 to provide a routing path to the cable lock 400 for the sheath 306. The lateral control element channel 364*a* then extends through the base 342 and to a second end 368*a* adjacent to the lateral distal end 348 of the lateral sidewall 344. The second end 368*a* of the lateral control element channel 364*a* may be defined by a conduit 370*a* formed on the outer surface 354 of the lateral sidewall 344. Accordingly, the lateral control element channel 364*a* transitions from the outer surface 354 on the base 342, through the cradle 304 to the inner surface 352, and then along the outer surface 354 of the lateral sidewall 344 through the conduit 370*a*.

A medial control element channel 364*b* extends from a first end 366*b* formed in the outer surface 354 of the base 342, as shown in FIG. 7. The first end 366*b* is formed at a medial edge of the recess 358, adjacent a posterior end of the recess 358, and opposes one of the notches 228*a* formed in the upper surface 224 of the lower core 208 to provide a routing path for the sheath 306. The medial control element channel 364*b* then extends through the base 342 and to a second end 368*b* adjacent to the medial distal end 350 of the medial sidewall 346. The second end 368*b* of the medial control element channel 364*b* may be defined by a conduit 370*b* formed on the outer surface 354 of the medial sidewall 346. Accordingly, the medial control element channel 364*b* transitions from the outer surface 354 on the base 342, through the cradle 304 to the inner surface 352, and then along the outer surface 354 of the medial sidewall 346 through the conduit 370*b*.

Referring still to FIGS. 8 and 9, the cradle 304 includes a pair of tensioning element channels 372*a*, 372*b* configured to provide a routing path for the tensioning element 312 from the cable lock 400 to the upper 100. Particularly, the tensioning element channels 372*a*, 372*b* are configured to slidably route ends of the tensioning element 312 from the upper 100 to the cable lock 400.

A lateral tensioning element channel 372*a* extends from a first end 374*a* formed in the outer surface 354 of the base 342. As shown in FIG. 7, the first end 374*a* is formed at a lateral edge of the recess 358, adjacent an anterior end of the recess 358, and opposes one of the notches 228*b* formed in the upper surface 224 of the lower core 208 to provide a routing path for the tensioning element 312. The lateral tensioning element channel 372*a* then extends through the base 342 and to a second end 376*a* at a posterior end 341*b* of the lateral sidewall 344. The second end 376*a* of the lateral tensioning element channel 372*a* may be defined by a conduit 378*a* formed on the outer surface 354 of the lateral sidewall 344. Accordingly, the lateral tensioning element channel 372*a* transitions from the outer surface 354 on the base 342, through the cradle 304 to the inner surface 352, and then along the outer surface 354 of the lateral sidewall 344 through the conduit 378*a*.

A medial tensioning element channel 372*b* extends from a first end 374*b* formed in the outer surface 354 of the base 342. As shown in FIG. 7, the first end 374*b* is formed at a medial edge of the recess 358, adjacent an anterior end of the recess 358, and opposes one of the notches 228*b* formed in the upper surface 224 of the lower core 208 to provide a routing path for the tensioning element 312. The medial tensioning element channel 372*b* then extends through the base 342 and to a second end 376*b* at a posterior end 341*b* of the medial sidewall 346. The second end 376*b* of the medial tensioning element channel 372*b* may be defined by a conduit 378*b* formed on the outer surface 354 of the medial sidewall 346. Accordingly, the medial tensioning element channel 372*b* transitions from the outer surface 354, through the cradle 304 to the inner surface 352, and then along the outer surface 354 through the conduit 378*b*.

As shown in FIGS. 8 and 9, in some examples the tensioning element channels 372*a*, 372*b* may intersect the respective control element channels 364*a*, 364*b*. Accordingly, the tensioning element channels 372*a*, 372*b* or the control element channels 364*a*, 364*b* may be provided with sleeves 380 (FIGS. 1A-2B) that are configured to receive the cable 302 therein and to prevent direct contact between the tensioning element 312 and the control element 314 at the intersection of the channels 364*a*, 364*b*, 372*a*, 372*b*. In the illustrated example, the sleeves 380 are disposed within the tensioning element channels 372*a*, 372*b* and receive respective portions of the tensioning element 312 therein, as best shown in FIGS. 1A-2B. The sleeves 380 may be formed of a lubricous polymeric material, whereby the tensioning element 312 can move easily within the sleeve 380 and the sheath 306 can slide easily over an exterior surface of the sleeve 380. In other examples, the control element channels 364*a*, 364*b* may be provided with the sleeves in addition or alternative to the sleeves 380 of the tensioning element channels 372*a*, 372*b*. In other examples of the cradle 304, the tensioning element channels 372*a*, 372*b* may be formed completely separate from control element channels 364*a*, 364*b* within the cradle 304, whereby the tensioning element 312 and the control element 314 are separated from each other by the material of the cradle 304.

Each of the lateral sidewall 344 and the medial sidewall 346 include a plurality of eyelets 382 configured for routing the tensioning element 312 of the cable 302 along the quarter panels 106 of the upper 100. As shown in FIGS. 8 and 9, each of the sidewalls 344, 346 includes a series of the eyelets 382 arranged along the respective distal end 348, 350 of the sidewall 344, 346. Particularly, the eyelets 382 are evenly spaced apart from each other and are disposed between the control element channels 364*a*, 364*b* and the anterior ends 341*a* of the sidewalls 344, 346. The cradle 304 may also include one or more eyelets 382 disposed in intermediate portions of the sidewalls 344, 346, between the series of the eyelets 382 along the distal ends 348, 350 and the base 342. In the illustrated example, at least one of the intermediate eyelets 382*a* is elongate, and forms a slot through the respective sidewall 344, 346.

Figure 6:
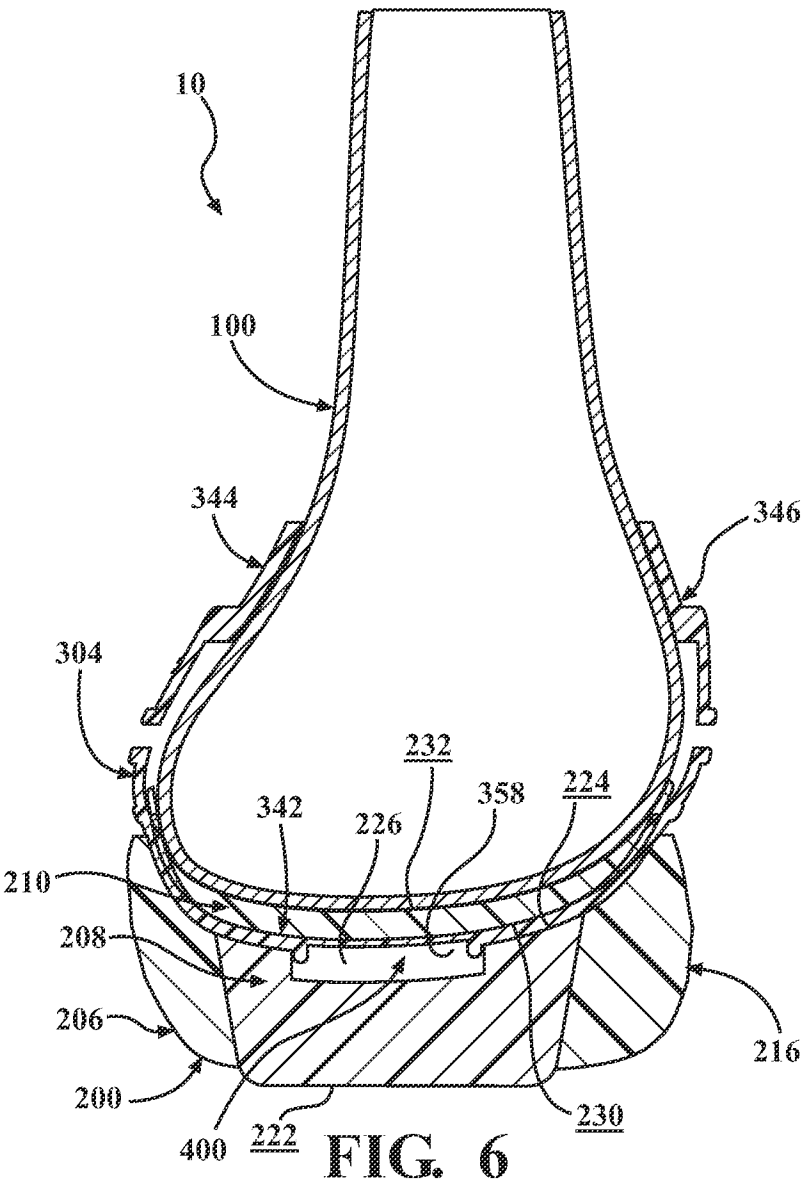
FIG. 6 is a cross-sectional view of the article of footwear of FIG. 1A, taken along line 6-6 of FIG. 4.
Figure 5:
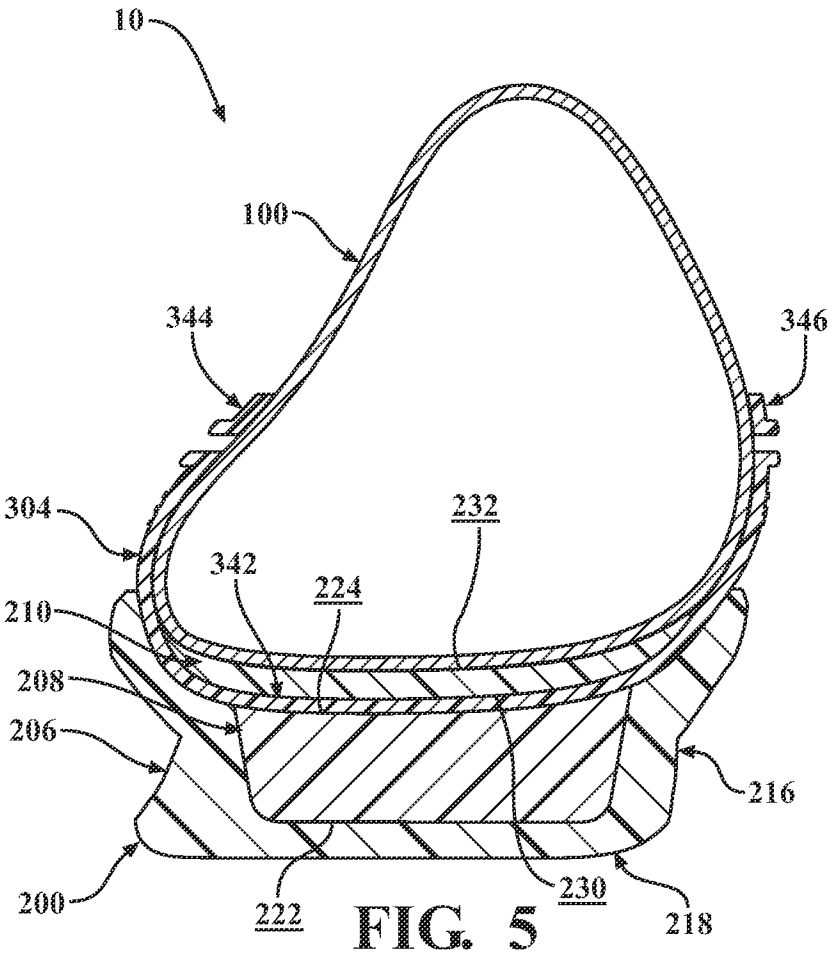
FIG. 5 is a cross-sectional view of the article of footwear of FIG. 1A, taken along line 5-5 of FIG. 3.

As shown in the cross-sectional views of FIGS. 6 and 7, the eyelets 382, 382*a* of the illustrated example extend through the cradle 304 along a substantially horizontal direction (i.e. parallel to a ground surface). However, in other examples, the eyelets 382, 382*a* of the cradle may be formed at an oblique angle to direct the cable 302 in a desired direction. Furthermore, each of the eyelets 382, 382*a* includes a flange 384, 384*a* formed on the outer surface 354 of the cradle 304 and surrounding the eyelet 382, 382*a*. Although the flanges 384, 384*a* of the illustrated example have a substantially uniform height from the outer surface 354, in other examples the flanges 384, 384*a* may have a tapered or variable height to guide the cable 302 in a desired direction along the cradle 304 and/or the upper 100.

As introduced above, the tensioning system 300 may further include a plurality of straps 308, 310 configured to distribute the forces applied by the cable 302 along the upper. In the illustrated example, the tensioning system 300 includes one or more forefoot straps 308 extending across the throat 108 of the upper 100. Each forefoot strap 308 includes a first end 386*a* disposed adjacent to the quarter panel 106 on the lateral side 16 of the upper 100, a second end 386*b* disposed adjacent to the quarter panel 106 on the medial side 18 of the upper 100, and an intermediate portion 388 that extends over the throat 108. Each end 386*a*, 386*b* of the forefoot strap 308 may include a routing feature for receiving the cable 302 therethrough. In the illustrated example, the ends 386*a*, 386*b* are formed as loops 390*a*, 390*b* through which the cable 302 can be routed. However, in other examples, the ends 386*a*, 386*b* of the forefoot strap 308 may include peripheral routing features, such as polymeric cable guides or the like. As discussed in greater detail below, additional forefoot straps 308 may be easily added to the tensioning system 300 by changing the routing of the tensioning element 312 of the cable 302 along the eyelets 382, 382*a* of the cradle 304.

Referring still to FIGS. 1A-2B, the tensioning system 300 further includes the heel strap 310, which extends around the heel counter 112 of the upper 100. The heel strap 310 includes a first end 392*a* disposed adjacent to the heel counter 112 on the lateral side 16 of the upper 100, a second end 392*b* disposed adjacent to the heel counter 112 on the medial side 18 of the upper 100, and an intermediate portion 394 that extends over heel counter 112 at the posterior end 14. As shown, the intermediate portion 394 is received within the groove 124 of the heel clip 122. Each end 392*a*, 392*b* of the forefoot strap 310 may include a routing feature for receiving the cable 302 therethrough. In the illustrated example, the ends 392*a*, 392*b* are formed as loops 396*a*, 396*b* through which the cable 302 can be routed. However, in other examples, the ends 392*a*, 392*b* of the forefoot strap 308 may include peripheral routing features, such as polymeric cable guides or the like.

Optionally, the tensioning system 300 may include additional routing features attached to the upper 100 and/or the cradle 304. For example, in some instances the upper 100 and/or the cradle 304 may include a plurality of cable guides for routing the cable 302. In some examples, the cable guides are formed by fabric or mesh loops defining a passage for slidably receiving the cable 302 therethrough. In some examples, the cable guides are formed of a rigid polymeric material, and have arcuate inner surfaces that are lined or coated with a low-friction material, such as a lubricous polymer (e.g., polytetrafluoroethylene), that facilitates movement of the cable 302 therein. Examples of such cable guides are described and shown in U.S. Application Publication No. 2018/0228244, the disclosure of which is hereby incorporated by reference in its entirety.

With reference to FIGS. 1A and 1B, the lateral strand 316 of the tensioning element 312 is routed from the first end 324 at the cable lock 400 and into the first end 374*a* of the lateral tensioning element channel 372*a*. The lateral strand 316 then passes through the lateral tensioning element channel 372*a* and into one of the polymeric sleeves 380 that extends through the conduit 378*a* to the posterior end 341*b* of the lateral sidewall 344 of the cradle 304. As shown, the conduit 378*a* may be oriented at an oblique angle relative to the ground surface, and parallel to the tapered distal end 348 of the lateral sidewall 344. From the lateral tensioning element channel 372*a*, the lateral strand 316 is routed through the loop 396*a* on the first end 392*a* of the heel strap 310 and then back to the cradle 304. At the cradle 304, the second end 330 of the lateral strand 316 is routed through a first one of the eyelets 382 adjacent to the posterior end 341*b* of the lateral sidewall 344 and attached to a second one of the eyelets 382 adjacent to the anterior end 341*a* of the lateral sidewall 344. A length of the lateral strand 316 extending between the two eyelets 382 is passed through the loop 390*a* formed on the lateral end 386*a* of the forefoot strap 308. Referring to FIGS. 2A and 2B, the medial strand 318 of the tensioning element 312 is routed in the same manner as the lateral strand 316, relative to the corresponding features formed on the medial side 18 of the article of footwear.

In the illustrated example, the second ends 326, 330 of the lateral strand 316 and the medial strand 318 are independently attached to the cradle 304. Accordingly, when the tensioning system 300 is moved to the tightened state, the lateral strand 316 may have a first tension while the medial strand 318 has a different, second tension. In other examples, the second ends 326, 330 of the lateral strand 316 and the medial strand 318 may be attached to each other in an intermediate portion of the article of footwear 10, such as along the throat 108 or within the sole structure 200. Here, forces applied to one of the strands 316, 318 may be transmitted to the other of the strands 316, 318 to maintain substantially uniform tension along the entire tensioning element 312.

Although the tensioning element 312 is shown as being routed through a single forefoot strap 308, the provision of a plurality of eyelets 382 within the cradle 304 allows for different configurations of forefoot straps 308 to the article of footwear 10. For example, instead of routing the tensioning element 312 directly from the posterior-most eyelet 382 to the anterior-most eyelet 382, whereby only a single length of the cable 302 is provided along the distal ends 348, 350 of the sidewalls 344, 346, the tensioning element 312 may be routed through intermediate ones of the eyelets 382 to provide a plurality of separated lengths of the cable 302 extending along the sidewalls 344, 346 of the cradle. In this example, the article of footwear 10 may be provided with a plurality of individual forefoot straps 308 similar to the forefoot strap 308 shown in FIGS. 1A-2B. Here, lateral ends 386*a* of each of the straps 308 would each receive one of the lengths of the lateral strand 316 of the tensioning element 312, while corresponding medial ends 386*b* of each of the straps 308 would each receive one of the lengths of the medial strand 316 of the tensioning element. In another example, the lateral strand 316 may be routed differently along the eyelets 382 of the lateral sidewall 344 than the medial strand 318 is routed along the eyelets 382 of the medial sidewall 346. For example, one of the strands 316, 318 may be routed as shown in FIGS. 1A-2B, providing a single length of the cable 302, while the other one of the strands 316, 318 may be routed through a plurality of the eyelets 382 to provide multiple lengths of the cable 302. Here, the forefoot strap may be a V-shaped forefoot strap, whereby a pair of straps extend from respective separate ends on one side of the upper 100 to a single end on the other side of the upper 100.

With continued reference to FIGS. 1A and 1B, the sheath 306 and the lateral strand 320 of the control element 314 are routed up through the lateral control element channel 364*a* in the lateral sidewall 344 and pass inside of the sleeve 380 that houses the lateral strand 316 of the tensioning element 312. From the lateral control element channel 364*a*, the lateral strand 320 of the control element 314 and the sheath 306 are routed over the throat 108, adjacent the ankle opening 104. Referring to FIGS. 2A and 2B, the medial strand 320 of the control element and the sheath 306 are routed in a similar manner from the medial control element 364*b* to the throat 108 of the upper 100, whereby the second ends 334, 338 of the lateral strand 316 and the medial strand 318 are attached to each other, directly or indirectly, to form a continuous control element 314 extending over the throat 108 of the upper 100.

As discussed above, the locking device or cable lock 400 may be disposed within the recesses 226, 358 of the lower core 208 and the cradle 304, and may be biased to a locked state to restrict movement of the adjustment elements 312, 314 in the their respective loosening directions $D_L$. The tensioning element 312 and the control element 314 each approach and pass through a housing 402 of the cable lock 400 from opposite directions. In some configurations, the cable lock 400 permits movement of the adjustment elements 312, 314 in the tightening directions $D_T$ while in the locked state. The release mechanism 404 may transition the cable lock 400 from the locked state to an unlocked state to thereby permit the adjustment elements 312, 314 to move in both directions $D_T$, $D_F$.

Referring again to FIG. 1, the release mechanism 404 is operable to transition the cable lock 400 from a locked state to an unlocked state to permit the adjustment elements 312, 314 to move in both directions $D_T$, $D_F$. For instance, the release mechanism 404 may include a release cord or cable 404 operable to transition the cable lock 400 from the locked state to the unlocked state when the release cord 404 is pulled. The release cord 404 may extend from a first end 406 attached to the cable lock 400 to a distal end 408 secured within the channel 126 of the clip 122 at the posterior end 14 of the upper 100, thereby permitting a user to grip and pull the release cord 404 for moving the cable lock 400 from the locked state to the unlocked state.

In some examples, the release cord 404 includes a gripping feature 410, such as a loop or sheath, located remotely from the cable lock 400 to allow a user to grip and pull the release cord 404 when it is desirable to move the cable lock 400 into the unlocked state and/or release the cable lock 400 from the unlocked state. FIG. 1 shows the gripping feature 410 of the release cord 404 formed adjacent to the clip 122 at the posterior end 14 of the upper 100.

Figure 11:
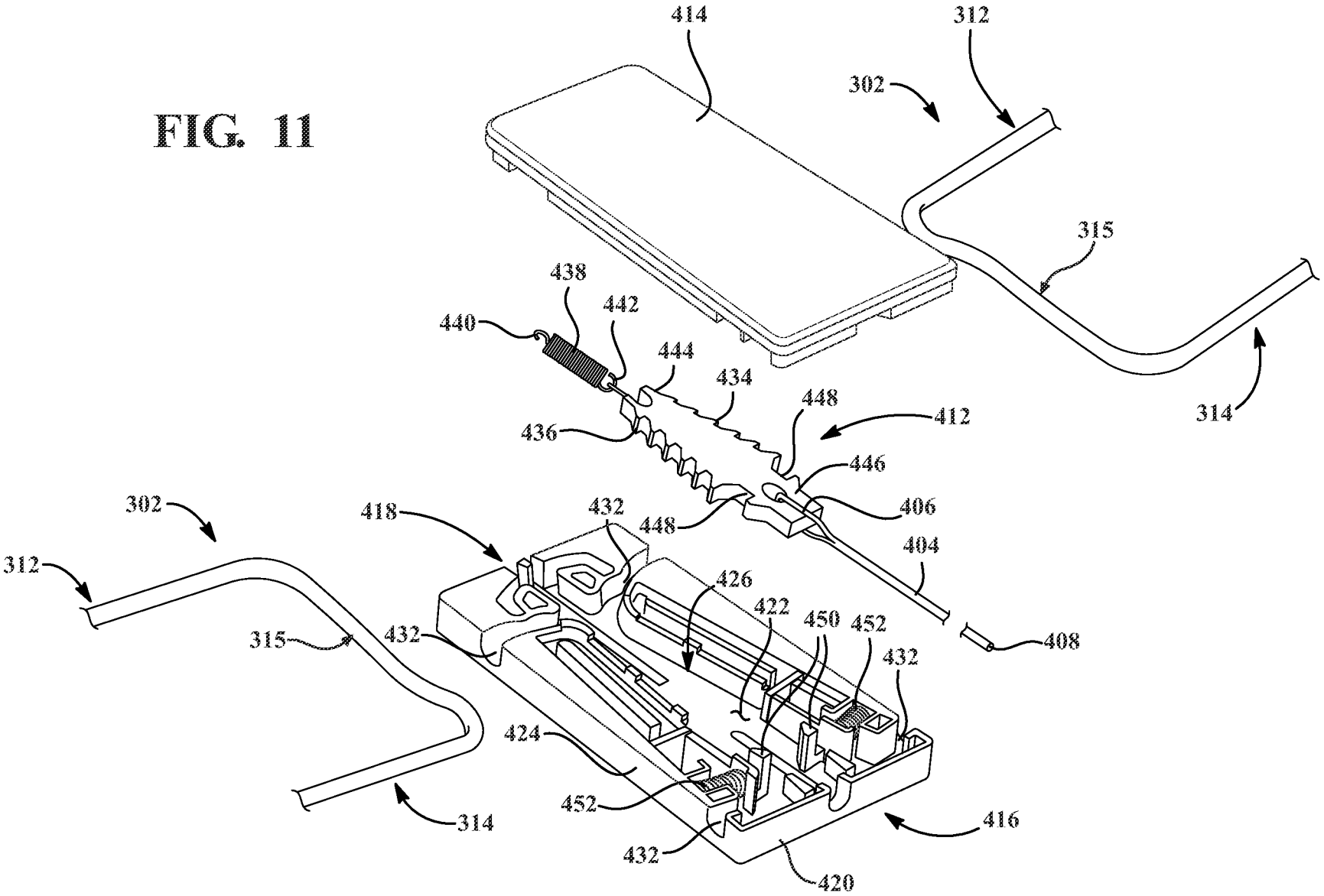
FIG. 11 is an exploded view of the cable lock of FIG. 10.

In some implementations, the cable lock 400 includes the housing 402 and a locking member or lock member 412 slidably disposed within the housing 402 and enclosed by a lid 414 releasably fastened to the housing 402. FIG. 11 provides an exploded view of the cable lock 400 of FIG. 10 showing the locking member 412 and the lid 414 removed from the housing 402. The housing 402 defines a length extending between a first end 416 and a second end 418. The housing 402 includes a base portion 420 having a cable-receiving surface 422 and a mounting surface 424 disposed on an opposite side of the base portion 420 than the cable-receiving surface 422 and opposing the exterior surface of the upper 100. The lid 414 opposes the cable-receiving surface 422 of the base portion 420 to define a locking member cavity 426 therebetween that is configured to receive the locking member 412 and a portion of the tensioning system 300. In some configurations, the locking member cavity 426 is bounded by a first engagement surface 428 and a second engagement surface 430 (FIGS. 12 and 13) that converge toward one another such that the locking member cavity 426 is associated with a wedge-shaped configuration tapering toward the second end 418 of the housing 402. Accordingly, the first engagement surface 428 and the second engagement surface 430 include corresponding sidewalls of the housing 402 converging toward one another and extending between the lid 414 and the cable-receiving surface 422 of the base portion 420 to define the locking member cavity 426.

As discussed above, the cable 302 of the tensioning system 300 may include a tensioning element 312 and a control element 314, which are connected to each other by a locking element 315 that extends through the locking member cavity 426 and includes a first portion extending along the first engagement surface 428 and a second portion extending along the second engagement surface 430. The tensioning element 312 exits out of corresponding slots 432 (FIGS. 12 and 13) formed through opposing sidewalls of the housing 402 proximate to the first end 416. The control element 314 exits out of corresponding slots 432 (FIGS. 12 and 13) formed through the opposing sidewalls of the housing 402 proximate to the second end 418.

In some implementations, the locking member 412 includes a first lock surface 434 opposing the first engagement surface 428 of the housing 402 and a second lock surface 436 opposing the second engagement surface 430 of the housing 402 when the locking member 412 is disposed within the locking member cavity 426 of the housing 402. In some examples, the first lock surface 434 and the second lock surface 436 converge toward one another. Additionally or alternatively, the first lock surface 434 may be substantially parallel to the first engagement surface 428 and the second lock surface 436 may be substantially parallel to the second engagement surface 430. In the example shown, the locking surfaces 434, 436 include projections or teeth each having an angled surface to permit movement by tensioning system 300 in the tightening direction $D_T$ (i.e., when the tightening force $F_T$ is applied to control element 314) while restricting movement by the tensioning system 300 by gripping the locking element 315 in the loosening direction $D_L$ when the locking member 412 is in the locked state. A biasing member 438 (e.g., a spring) may include a first end 440 attached to the second end 418 of the housing 402 and a second end 442 attached to a first end 444 of the locking member 412 to attach the locking member 412 to the housing 402.

In some implementations, the locking member 412 is slidably disposed within the housing 402 and is movable between a locked position (FIG. 12) associated with the locked state of the cable lock 400 and an unlocked position (FIG. 13) associated with the unlocked state of the cable lock 400. In some examples, the release mechanism 404 (e.g., release cord 404) moves the locking member 412 from the locked position (FIG. 12) to the unlocked position (FIG. 13). The locking member 412 may include a tab portion 446 extending from an opposite end of the locking member 412 than the first end 444. In one configuration, the first end 406 of the release cord 404 attaches to the tab portion 446 of the locking member 412. The tab portion 446 may include a pair of retention features or recesses 448 formed in corresponding ones of the first lock surface 434 and the second lock surface 436 and selectively receiving one or more retention features 450 associated with the housing 402 to maintain the cable lock 400 in the unlocked state. The retention features 450 associated with the housing 402 may include a first retention feature 450 and a second retention feature 450 disposed on opposite sides of the housing 402, whereby the retention features 450 are biased inward toward the cavity 426 and one another by corresponding biasing members 452. The retention features 450 may be projections that are integrally formed with the housing 402 such that the retention features 450 act as living hinges movable between a retracted state (FIG. 12) and an extended state (FIG. 13).

FIG. 12 provides a top view of the cable lock 400 of FIG. 10 with the lid 414 removed to show the locking member 412 disposed within the cavity 426 of the housing 402 while in the locked position. In some examples, the locking member 412 is biased into the locked position. For instance, FIG. 12 shows the biasing member 438 exerting a biasing force $F_B$ (represented in a direction $D_B$) upon the locking member 412 to urge the first end 444 of the locking member 412 toward the second end 418 of the housing 402, and thereby bias the locking member 412 into the locked position. While in the locked position, the locking member 412 restricts movement of the tensioning system 300 relative to the housing 402 by pinching the locking element 315 of the tensioning system 300 between the lock surfaces 434, 436 and the engagement surfaces 428, 430. Accordingly, the locked position of the locking member 412 restricts the tensioning system 300 from moving in the loosening direction $D_L$. In the example shown, the locking member 412 permits movement of the tensioning system 300 when the tightening force $F_T$ is applied to the tightening grip 340, as this direction causes the tensioning system 300 to apply a force on the locking member 412 due to the generally wedge shape of the locking member 412, thereby moving the locking member 412 into the unlocked state. The locking member 412 automatically returns to the locked state once the force applied to the tightening grip 340 is released due to the forces imparted on the locking member 412 by the biasing member 438.

FIG. 13 provides a top view of the cable lock 400 of FIG. 10 with the lid 414 removed to show the locking member 412 disposed within the cavity 426 of the housing 402 while in the unlocked position. In some examples, the release cord 404 attached to the tab portion 446 of the locking member 412 applies a release force $F_R$ upon the locking member 412 to move the locking member 412 away from the first engagement surface 428 and the second engagement surface 430 relative to the housing 402. Here, the release force $F_R$ is sufficient to overcome the biasing force $F_B$ of the biasing member 438 to permit the locking member 412 to move relative to the housing 402 such that the pinching upon the locking element 315 of the tensioning system 300 between the lock surfaces 434, 436 and the engagement surfaces 428, 430 is released. In some examples, the biasing force $F_B$ causes the locking member 412 to transition back to the locked position when the release force $F_R$ applied by the release cord 404 is released. The release cord 404 may apply the release force $F_R$ when a release force $F_R$ of sufficient or predetermined magnitude is applied to pull the release cord 404 away from the upper 100 relative to the view of FIG. 13.

While in the unlocked position, the locking member 412 permits movement of the tensioning system 300 relative to the housing 402 by allowing the locking element 315 of the tensioning system 300 to freely move between the lock surfaces 434, 436 and the engagement surfaces 428, 430. The unlocked position of the locking member 412 permits movement of the tensioning system 300 in both the tightening direction $D_T$ and the loosening direction $D_L$ when the forces $F_T$, $F_L$ are applied to respective ones of the control element 314 and the tensioning element 312.

In some examples, a sufficient magnitude and/or duration of the release force $F_R$ applied to the release cord 404 causes the release cord 404 to apply the release force $F_R$ (FIG. 13) upon the locking member 412 in a direction opposite the direction of the biasing force $F_B$ (FIG. 12) such that the locking member 412 moves away from the engagement surfaces 428, 430 relative to the housing 402 and toward the first end 416 of the housing 402. At least one of the retention features 450 of the housing 402 may engage the retention feature 448 of the locking member 412 when release force $F_R$ moves the locking member 412 a predetermined distance away from the first engagement surface 428 and the second engagement surface 430 of the housing 402. Here, engagement between the retention feature 448 of the locking member 412 and the at least one retention feature 450 of the housing 402 maintains the locking member 412 in the unlocked position once the release force $F_R$ is released to cease the application of the release force $F_R$. The biasing force $F_B$ of the biasing member 438 and the forces exerted by the pair of biasing members 452 on the retention features 450 lock the retention feature 388*e* of the locking member 412 into engagement with the retention features 450 of the housing 402 after the locking member 412 moves the predetermined distance and the release force 398 is no longer applied.

In some scenarios, a release force $F_R$ associated with a first magnitude may be applied to the release cord 404 to move the locking member 412 away from the engagement surfaces 428, 430 by a distance less than the predetermined distance such that the retention features 448, 450 do not engage. In these scenarios, the release force $F_R$ associated with the first magnitude can be maintained when it is desirable to move the tensioning system 300 in the loosening direction $D_L$ or the tightening direction $D_T$ (e.g., by applying the tightening force $F_T$ to the tightening grip 340) for adjusting the fit of the interior void 102 around the foot. Once the desired fit of the interior void 102 around the foot is achieved, the release force $F_R$ can be released to cause the locking member 412 to transition back to the locked position so that movement of the tensioning system 300 is restricted in the loosening direction $D_L$ and the desired fit can be sustained. It should be noted that even when the locking member 412 is in the locked position, the tensioning system 300 can be moved in the tightening direction $D_T$. As such, once the release force $F_R$ is released and a desired fit is achieved, the locking member 412 automatically retains the desired fit by locking a position of the tensioning system 300 relative to the housing 402.

In other scenarios, a release force $F_R$ associated with a second magnitude greater than the first magnitude can be applied to the release cord 404 to move the locking member 412 the predetermined distance away from the engagement surfaces 428, 430 to cause the corresponding retention features 448, 450 to engage. Engagement of the retention features 448, 450 is facilitated by providing the retention features 450 with a tapered edge that opposes the locking member 412 to allow the locking member 412 to more easily move the retention features 450 against the biasing force $F_B$ imparted thereon by the biasing members 452 when the release cord 404 is pulled the predetermined distance. In these scenarios, engagement between the corresponding retention features 448, 450 maintains the locking member 412 in the unlocked position when the release force $F_R$ is released.

The locking member 412 is returned to the locked position when a tightening force $F_T$ is applied to the control element 314. Namely, when a force is applied to the lateral and medial strands 320, 322, these strands 320, 322 are placed in tension which, in turn, exerts a force on the biasing members 452 via the retention features 450, as the strands 320, 322 pass through a portion of the retention features 450. In so doing, the retention features 450 compress the biasing members 452 and, as such, cause the retention features 450 to move away from one another and disengage the retention features 448 of the locking member 412, thereby allowing the biasing member 438 to return the locking member 412 to the locked position.

In use, the article of footwear 10 can be selectively moved between a relaxed state (FIGS. 1A and 2A) and a tightened state (FIGS. 1B and 2B) using the tensioning system 300. With the footwear 10 initially provided in a relaxed state, an effective length of the strands 316, 318 of the tensioning element 312 (i.e., the lengths from the first ends 324, 328 to the second ends 326, 330) will be maximized, such that the tensioning element 312 is in a relaxed state about the upper 100, while an effective lengths of the strands 320, 322 of the control element 314 (i.e., the lengths from the first ends 332, 336 to the second ends 334, 338) is minimized. Accordingly, a foot of a user can be inserted into the interior void 102 of the footwear 10, whereby the materials of the upper 100 allow the upper 100 to stretch to accommodate the foot therein.

With the foot of the user inserted within the interior void 102 of the upper 100, the tensioning system 300 can be moved to a tightened state by the user to secure the footwear 10 to the foot. As discussed above, the tensioning system 300 is moved to the tightened state by applying a tightening force $F_T$ to the tightening grip 340 of the control element 314, thereby causing the control element 314 to move in the tightening direction $D_T$. As the control element 314 moves in the tightening direction $D_T$, the cable 302 is pulled through the housing 402 of the cable lock thereby causing the effective lengths of the strands 316, 318 of the tensioning element 312 to be reduced. Accordingly, an effective length of the tensioning element 312 is minimized around the upper 100 to move the upper 100 to a tightened state around the foot.

As discussed above, when the tensioning element 312 is moved in the tightening direction $D_T$, the lateral and medial strands 316, 318 distribute the tightening force $F_T$ to the ends 386*a*, 386*b* of the forefoot strap 308 to draw the forefoot strap 308 tight over the throat 108. Simultaneously, the lateral and medial strands 316, 318 of the tensioning element 312 distribute the tightening force $F_T$ to the ends 392*a*, 392*b* of the heel strap 310 to constrict the heel counter 112 around the rear of the ankle of the user. Simultaneously, the effective length of the control element 314 may be increased when the tensioning system 300 is moved to the tightened state. However, as shown in FIGS. 1B and 2B, the control element 314 is maintained in a taut position against the upper 100 by the elasticity of the sheath 306, which accommodates the increased effective length of the control element 314 by allowing the control element 314 to "bunch" within the sheath 306 when the sheath 306 is contracted.

When a user desires to remove the article of footwear 10 from the foot, the tensioning system 300 may be moved to the loosened state to allow the upper 100 to be relaxed around the foot. Initially, the cable lock 400 must be moved to the unlocked state by applying a sufficient release force $F_R$ to overcome the biasing force $F_B$ of the biasing member 438, as discussed above. Once the cable lock 400 is moved to the unlocked state, the cable 302 can be pulled in the loosening direction $D_L$ through the housing 402 of the cable lock by pulling the article of footwear 10 from the foot of the user, which inherently causes the upper to expand and increases the effective lengths of the strands 316, 318 of the tensioning element 312.

The following Clauses provide an exemplary configuration for an article of footwear and a cradle described above.

Clause 1: An article of footwear comprising an upper, a sole structure attached to the upper, a cradle having a base extending between the upper and the sole structure, a first sidewall extending from the base and along a first side of the upper, and a second sidewall extending from the base along a second side of the upper, each of the first sidewall and the second sidewall including a plurality of eyelets, and a cable operable to move the upper between a relaxed state and a tightened state and including a first strand extending through at least one of the eyelets of the first sidewall and a second strand extending through at least one of the eyelets of the second sidewall.

Clause 2: The article of footwear of Clause 1, wherein at least one of the first sidewall and the second sidewall includes a first cable channel, a first portion of the cable being routed through the first cable channel.

Clause 3: The article of footwear of Clause 2, wherein the at least one of the first sidewall and the second sidewall includes a second cable channel, a second portion of the cable being routed through the second cable channel.

Clause 4: The article of footwear of Clause 3, wherein the first cable channel intersects the second cable channel.

Clause 5: The article of footwear of Clause 3 or 4, wherein the second cable channel includes a sleeve disposed therein, the sleeve configured to receive the second portion of the cable.

Clause 6: The article of footwear of any of Clauses 3-5, wherein the first cable channel includes a portion of a sheath disposed therein, the sheath configured to receive the first portion of the cable.

Clause 7: The article of footwear of any of Clauses 1-6, wherein the cradle is formed of either a rigid material or a semi-rigid material, or a combination of a rigid material and a semi-rigid material.

Clause 8: The article of footwear of any of the preceding Clauses, further comprising a cable lock operable to selectively permit movement of the cable in a loosening direction.

Clause 9: The article of footwear of Clause 8, wherein the cable lock is disposed between the base of the cradle and a portion of the sole structure.

Clause 10: The article of footwear of Clause 8 or 9, wherein the cable lock is partially received within the base of the cradle.

Clause 11: The article of footwear of any of Clauses 8-10, wherein the base of the cradle includes one of either a recess or a through-hole that receives at least a portion of the cable lock.

Clause 12: The article of footwear of any of the preceding Clauses, wherein the base of the cradle is disposed within the sole structure.

Clause 13: The article of footwear of any of the preceding Clauses, wherein the cradle is disposed in a mid-foot region of the article of footwear.

Clause 14: The article of footwear of any of the preceding Clauses, wherein the first side of the upper is a lateral side and the second side of the upper is a medial side.

Clause 15: The article of footwear of any of the preceding Clauses, further comprising a forefoot strap extending over the upper from a first end to a second end, the first strand attached to the first end of the forefoot strap and the second strand attached to the second end of the forefoot strap.

Clause 16: The article of footwear of Clause 15, further comprising a heel strap extending around a heel counter of the upper from a first end to a second end, the first strand attached to the first end of the heel strap and the second strand attached to the second end of the heel strap.

Clause 17: The article of footwear of any of the preceding Clauses, wherein an end of the first strand is attached to the first sidewall and an end of the second strand is attached to the second sidewall.

Clause 18: The article of footwear of any of the preceding Clauses, wherein the first sidewall and the second sidewall are arcuate.

Clause 19: The article of footwear of any of the preceding Clauses, wherein the base, the first sidewall, and the second sidewall cooperate to define a channel, the upper being disposed within the channel.

Clause 20: The article of footwear of any of the preceding Clauses, wherein at least one of the first sidewall and the second sidewall includes an elongate channel operable to receive one of the first strand and the second strand.

Clause 21: A cradle for an article of footwear, the cradle comprising a base, a first sidewall extending from a first side of the base to a first distal end and including a first plurality of eyelets, and a second sidewall extending from a second side of the base to a second distal end and including a second plurality of eyelets.

Clause 22: The cradle of Clause 21, wherein the base, the medial sidewall, and the lateral sidewall cooperate to define a first channel extending along a length of the cradle and configured to receive an upper of an article of footwear therein.

Clause 23: The cradle of Clause 21 or 22, wherein at least one of the first sidewall and the second sidewall is arcuate.

Clause 24: The cradle of any of the preceding Clauses, wherein the base is substantially planar and each of first sidewall and the second sidewall is arcuate.

Clause 25: The cradle of any of the preceding Clauses, wherein at least one of the first distal end and the second distal end converges with the base along a direction from a first end of the cradle to a second end of the cradle.

Clause 26: The cradle of any of the preceding Clauses, wherein a height of at least one of the first sidewall and the second sidewall tapers along a direction from a first end of the cradle to a second end of the cradle.

Clause 27: The cradle of any of the preceding Clauses, wherein at least one of the first sidewall and the second sidewall includes a first cable channel configured to receive a first portion of a cable.

Clause 28: The cradle of Clause 27, wherein the at least one of the first sidewall and the second sidewall includes a second cable channel configured to receive a second portion of a cable.

Clause 29: The cradle of Clause 28, wherein the first cable channel intersects the second cable channel.

Clause 30: The cradle of Clause 28 or 29, wherein the second cable channel is configured to receive a sleeve therein, the sleeve configured to receive the second portion of the cable.

Clause 31: The cradle of any of Clauses 27-30, wherein the first cable channel is configured to receive a sheath therein, the sheath configured to receive the first portion of the cable.

Clause 32: The cradle of any of Clauses 28-31, wherein the base includes one of either a recess or a through-hole that receives at least a portion of the cable lock.

Clause 33: The cradle of Clause 32, wherein the recess is formed in an outer surface of the base.

Clause 34: The cradle of Clause 32 or 33, wherein the first cable channel extends from the recess to the first distal end of the first sidewall.

Clause 35: The cradle of Clause 34, wherein the second cable channel extends from the recess to a posterior end of the first sidewall.

Clause 36: The cradle of any of the preceding Clauses, wherein at least one of the plurality of the eyelets is elongate.

Clause 37: The cradle of any of the preceding Clauses, wherein at least one of the eyelets is cylindrical.

Clause 38: The cradle of any of the preceding Clauses, wherein at least one of the eyelets includes a flange circumscribing the eyelet.

Clause 39: The cradle of Clause 38, wherein the flange is formed on an outer surface of the cradle.

Clause 40: The cradle of Clause 38 or 39, wherein the flange has a uniform height.

Clause 41: The cradle of Clause 38 or 39, wherein the flange has a variable height.

Clause 42: The cradle of any of Clauses 21-41, wherein the base includes a tab extending from a posterior end of the base.

Clause 43: The cradle of Clause 42, wherein the tab includes a groove extending from the recess of the base to a posterior end of the tab.

Clause 44: The cradle of any of the preceding Clauses, wherein the cradle is formed of either a rigid material or a semi-rigid material, or a combination of a rigid material and a semi-rigid material.

Clause 45: An article of footwear including the cradle of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An article of footwear comprising:

an upper; and a cradle attached to the upper, the cradle including a first surface facing the upper and a second surface facing a ground surface, wherein the cradle is formed from a material having a higher rigidity than a material of the upper, and including a base, a medial sidewall extending from the base in a direction away from a ground-engaging surface of the article of footwear, and a lateral sidewall extending from the base in a direction away from the ground-engaging surface of the article of footwear, the medial sidewall and the lateral sidewall tapering in height along a longitudinal axis of the cradle from a posterior end to an anterior end, wherein the cradle includes a recess disposed within the base, the recess disposed in the second surface of the cradle.

2. The article of footwear of claim 1, wherein the cradle is attached to an outer surface of upper.

3. The article of footwear of claim 1, wherein the cradle opposes an outer surface of the upper.

4. The article of footwear of claim 1, wherein the medial sidewall and the lateral sidewall each includes an arcuate shape.

5. The article of footwear of claim 1, wherein the medial sidewall and the lateral sidewall each includes a concave inner surface that opposes an outer surface of the upper, and wherein the medial sidewall and the lateral sidewall each includes a convex outer surface disposed on an opposite side of the medial sidewall and lateral sidewall than the respective concave inner surface.

6. The article of footwear of claim 1, wherein the base, the medial sidewall, and the lateral sidewall cooperate to provide the cradle with a U-shaped channel extending along the longitudinal axis of the cradle between the posterior end and the anterior end.

7. The article of footwear of claim 1, wherein at least one of the medial sidewall and the lateral sidewall includes at least one eyelet formed through a thickness thereof.

8. The article of footwear of claim 1, wherein at least one of the medial sidewall and the lateral sidewall includes a channel, and wherein a tightening element operable to move the upper from a relaxed state to a constricted state is received by the channel and the recess.

9. The article of footwear of claim 1 further comprising:

a forefoot region, a mid-foot region, and a heel region; and a midsole including a first core, wherein the first core includes a first surface facing the upper and a second surface facing a ground surface, wherein the cradle is attached the first surface of the first core in the mid-foot region.

10. An article of footwear comprising:

a forefoot region, a mid-foot region, and a heel region;

an upper;

a midsole including a first core, wherein the first core includes a first surface facing the upper and a second surface facing a ground surface; and a cradle attached to the upper and the first surface of the first core in the mid-foot region, formed from a material having a higher rigidity than a material of the upper, and including a base, a medial sidewall extending from the base in a direction away from a ground-engaging surface of the article of footwear and terminating at a first distal end, and a lateral sidewall extending from the base in a direction away from the ground-engaging surface of the article of footwear and terminating at a second distal end, the first distal end disposed closer to the second distal end across a width of the cradle at a posterior end of the cradle than at an anterior end of the cradle.

11. The article of footwear of claim 10, wherein the cradle is attached to an outer surface of upper.

12. The article of footwear of claim 10, wherein the cradle opposes an outer surface of the upper.

13. The article of footwear of claim 10, wherein the medial sidewall and the lateral sidewall each includes an arcuate shape.

14. The article of footwear of claim 10, wherein the medial sidewall and the lateral sidewall each includes a concave inner surface that opposes an outer surface of the upper, and wherein the medial sidewall and the lateral sidewall each includes a convex outer surface disposed on an opposite side of the medial sidewall and lateral sidewall than the respective concave inner surface.

15. The article of footwear of claim 10, wherein the base, the medial sidewall, and the lateral sidewall cooperate to provide the cradle with a U-shaped channel extending along a longitudinal axis of the cradle between the posterior end and the anterior end.

16. The article of footwear of claim 10, wherein at least one of the medial sidewall and the lateral sidewall includes at least one eyelet formed through a thickness thereof.

17. The article of footwear of claim 10, wherein at least one of the medial sidewall and the lateral sidewall includes a channel, and wherein a tightening element operable to move the upper from a relaxed state to a constricted state is received by the channel.

18. The article of footwear of claim 10, wherein the cradle includes a first surface facing the upper and a second surface facing a ground surface, wherein the cradle includes a recess disposed in the second surface.

* * * * *